US010591829B2

(12) United States Patent
Katsumata

(10) Patent No.: US 10,591,829 B2
(45) **Date of Patent: *Mar. 17, 2020**

(54) TONER HAVING LOW TEMPERATURE FIXING AND HIGH DURABILITY CHARACTERISTICS

(71) Applicants: KABUSHIKI KAISHA TOSHIBA, Tokyo (JP); TOSHIBA TEC KABUSHIKI KAISHA, Tokyo (JP)

(72) Inventor: Tsutomu Katsumata, Ito Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/925,398

(22) Filed: Mar. 19, 2018

(65) Prior Publication Data

US 2018/0210360 A1 Jul. 26, 2018

Related U.S. Application Data

(63) Continuation of application No. 15/163,101, filed on May 24, 2016, now Pat. No. 9,921,504.

(30) Foreign Application Priority Data

Jun. 16, 2015 (JP) ..... 2015-121285

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 15/08*** | (2006.01) |

(52) U.S. Cl.

CPC ..... *G03G 9/08755* (2013.01); *G03G 9/0804* (2013.01); *G03G 9/0808* (2013.01); *G03G 9/0819* (2013.01); *G03G 9/08782* (2013.01); *G03G 9/08795* (2013.01); *G03G 9/08797* (2013.01); *G03G 15/08* (2013.01)

(58) Field of Classification Search

CPC ..... G03G 9/087; G03G 9/08792
USPC ..... 430/109.4, 108.4
See application file for complete search history.

(56) References Cited

U.S. PATENT DOCUMENTS

| | | | | |
|---|---|---|---|---|
| 5,257,075 | A * | 10/1993 | Ohki | G03G 13/08 399/284 |
| 5,635,325 | A | 6/1997 | Inaba et al. | |
| 9,235,148 | B2 | 1/2016 | Sugahara et al. | |
| 9,665,024 | B2 * | 5/2017 | Moriya | G03G 9/092 |
| 9,921,504 | B2 * | 3/2018 | Katsumata | G03G 9/0804 |
| 2011/0183251 | A1 | 7/2011 | Katsumata | |
| 2011/0281214 | A1 | 11/2011 | Kuroyama | |
| 2013/0071783 | A1 * | 3/2013 | Kuroyama | G03G 9/08755 430/105 |
| 2013/0260300 | A1 * | 10/2013 | Araki | G03G 9/09378 430/105 |
| 2015/0309431 | A1 * | 10/2015 | Katsumata | G03G 9/08755 430/105 |
| 2015/0309435 | A1 * | 10/2015 | Kuroyama | G03G 9/08755 430/105 |
| 2016/0370724 | A1 | 12/2016 | Katsumata | |
| 2018/0210360 | A1 * | 7/2018 | Katsumata | G03G 9/0804 |

FOREIGN PATENT DOCUMENTS

| | | | |
|---|---|---|---|
| JP | 3287733 | B2 | 6/2002 |
| JP | 2009-145572 | A | 7/2009 |
| JP | 2011-237801 | A | 11/2011 |
| JP | 2014-106252 | A | 6/2014 |
| JP | 5559738 | B2 | 7/2014 |

OTHER PUBLICATIONS

Notification of Reasons for Refusal dated Jan. 8, 2019 in corresponding Japanese Patent Application No. 2015-121285 with English machine translation, 4 pages.

* cited by examiner

*Primary Examiner* — Janis L Dote
(74) *Attorney, Agent, or Firm* — Kim & Stewart LLP

(57) ABSTRACT

A toner according to an embodiment includes a colorant, a binder resin, and an ester wax. The colorant, the binder resin and the ester wax form a toner particle. The ester wax contains two or more ester compounds represented by the general formula $R^1COOR^2$, where $R^1$ and $R^2$ each independently is an alkyl group. The total number of carbon atoms of $R^1$ and $R^2$ is in a range from 31 to 53. The two or more ester compounds have different number of carbon atoms from each other.

16 Claims, 5 Drawing Sheets

TONER HAVING LOW TEMPERATURE FIXING AND HIGH DURABILITY CHARACTERISTICS

CROSS-REFERENCE TO RELATED APPLICATIONS

This application is a continuation of U.S. patent application Ser. No. 15/163,101, filed on May 24, 2016, which is based upon and claims the benefit of priority from Japanese Patent Application No. 2015-121285, filed on Jun. 16, 2015, the entire contents of each of which are incorporated herein by reference.

FIELD

Embodiments described herein relate generally to a toner for use in an image forming apparatus.

BACKGROUND

Generally, an electrostatic charge image and a magnetic latent image are developed by using a toner, in an electrophotographic method, an electrostatic printing method, a magnetic recording method, or the like. From a viewpoint of energy saving through the recent environmental consideration, low-temperature fixing is required for the toner.

A toner containing an ester wax is known as a toner which is excellent in low-temperature fixing. Regarding the ester wax, the number of carbon atoms of an ester compound contained in the maximum content is small, the content thereof is large, and distribution of carbon atoms of ester compounds constituting the ester wax is sharp. Such a toner is excellent in low-temperature fixing, but durability is not sufficiently obtained.

A toner which contains a crystalline polyester resin and an ester wax is known. Regarding the ester wax, the number of carbon atoms of an ester compound contained in the maximum content is large, and distribution of carbon atoms of ester compounds constituting the ester wax is sharp. Since the toner contains the crystalline polyester resin, the toner is excellent in low-temperature fixing. However, regarding the toner, distribution of carbon atoms of ester compounds constituting the ester wax is sharp, and the ester wax is easily precipitated on a surface of a toner particle. If the ester wax is precipitated on the surface of the toner particle, charge stability is damaged. If the charge stability is damaged, maintaining a high-quality image for a long term is not possible. That is, long-life characteristics become insufficient. In addition, sufficient durability is not obtained.

Further improvement of the long-life characteristics is required for a toner in accordance with a high speed and high image quality of an image forming apparatus. Further improvement of the low-temperature fixing and the durability is also required for the toner.

DETAILED DESCRIPTION

Figure 1:
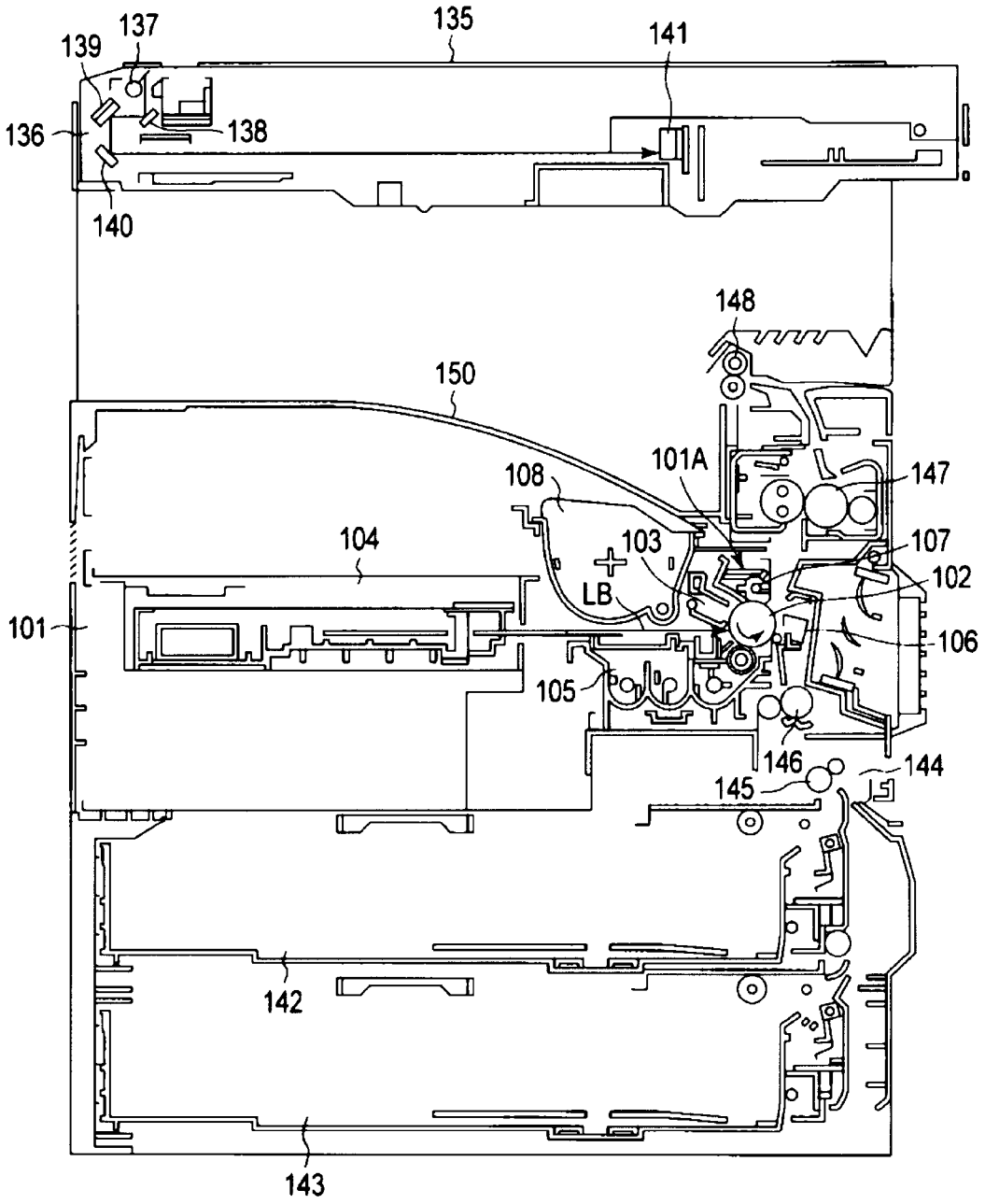
FIG. 1 is a side view illustrating an image forming apparatus according to an embodiment.

Embodiments described herein provide a toner having excellent low-temperature fixing, durability, and long-life characteristics.

In general, a toner according to an embodiment includes a colorant, a binder resin, and an ester wax. The colorant, the binder resin and the ester wax form a toner particle. The ester wax contains two or more ester compounds represented by the general formula $R^1COOR^2$, where $R^1$ and $R^2$ each independently is an alkyl group. The total number of carbon atoms of $R^1$ and $R^2$ is in a range from 31 to 53. The two or more ester compounds have different number of carbon atoms from each other.

Hereinafter, a toner according to an embodiment will be described.

The toner according to the embodiment includes a toner particle containing a colorant, a binder resin, and an ester wax.

Regarding the toner particle, the mean volume diameter of a group of toner particles is in a range of, for example, 3 μm to 20 μm. If the mean volume diameter is less than 3 μm, obtaining of a desired developing amount is difficult. If the mean volume diameter is greater than 20 μm, reproducibility or granularity of a definition image maybe damaged. The mean volume diameter is preferably in a range of 4 μm to 10 μm, and is more preferably 4 μm to 8 μm.

The toner according to the embodiment is used as an electrophotographic toner, for example.

The colorant will be described.

The colorant in the embodiment is not particularly limited. However, examples of the colorant include carbon black, an organic or inorganic pigment, and a dye.

Examples of the carbon black include aniline black, lamp black, acetylene black, furnace black, thermal black, channel black, and Ketjen black.

Examples of the pigment or the dye include Fast Yellow G, benzidine yellow, chrome yellow, quinoline yellow, Indian fast Orange, Irgazin red, carmine FB, permanent bordeaux FRR, Pigment Orange R, lithol Red 2G, Lake Red C, Rhodamine FB, Rhodamine B lake, Du Pont Oil Red, phthalocyanine blue, Pigment blue, aniline blue, Calcoil Blue, ultramarine blue, brilliant green B, phthalocyanine green, malachite green oxalate, methylene blue chloride, Rose Bengal, and quinacridone.

Using marks by Color Index Number, examples of the colorant include C.I. Pigment Black 1, 6, and 7; C.I. Pigment Yellow 1, 12, 14, 17, 34, 74, 83, 97, 155, 180, and 185; C.I. Pigment Orange 48 and 49; C.I. Pigment Red 5, 12, 31, 48, 48:1, 48:2, 48:3, 48:4, 48:5, 49, 53, 53:1, 53:2, 53:3, 57, 57:1, 81, 81:4, 122, 146, 150, 177, 185, 202, 206, 207, 209, 238, and 269; C.I. Pigment Blue 15, 15:1, 15:2, 15:3, 15:4, 15:5, 15:6, 75, 76, and 79; C.I. Pigment Green 1, 7, 8, 36, 42, and 58; C.I. Pigment Violet 1, 19, and 42; and C.I. Acid Red 52.

These colorants may be used singly or in combination of two or more types.

An added amount of the colorant is not particularly limited. However, 4 to 15 parts by mass of the colorant is preferable with respect to 100 parts by mass of the binder resin.

If the added amount of the colorant is equal to or greater than the lower limit value, color reproducibility is easily improved. If the added amount of the colorant is equal to or smaller than the upper limit value, dispersibility of the colorant is improved, and low-temperature fixing and long-life characteristics are easily improved.

The binder resin will be described.

Examples of the binder resin in the embodiment include polyester resins, polystyrene resins, polyurethane resins, and epoxy resins. Examples of the polyester resin include amorphous polyester resins and crystalline polyester resins. The binder resin in the embodiment preferably contains the crystalline polyester resin. As the binder resin in the embodiment, the amorphous polyester resin and the crystalline polyester resin are preferably used together.

The amorphous polyester resin will be described.

As the amorphous polyester resin, a substance obtained by polycondensing bivalent or higher alcohol, also sometimes called diol, and bivalent or higher carboxylic acid, also sometimes called diacid, is exemplified. Examples of the bivalent or higher carboxylic acid include bivalent or higher carboxylic acid. Acid anhydrides or esters thereof may also be used. As the ester thereof, lower (carbon atoms of 1 to 12) alkyl ester of bivalent or higher carboxylic acid is exemplified.

Examples of the bivalent alcohol include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, and an alkylene oxide adduct of bisphenol A. As the alkylene oxide adduct of bisphenol A, a compound obtained by adding averagely 1 to 10 mol of alkylene oxide having carbon atoms of 2 to 3, to bisphenol A is exemplified. Examples of the alkylene oxide adduct of bisphenol A include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane. As the bivalent or higher alcohol, the alkylene oxide adduct of bisphenol A is preferable.

Examples of trivalent or higher alcohol include sorbitol, 1,2,3,6-hexane tetrol, 1,4-sorbitan, pentaerythritol, dipentaerythritol, tripentaerythritol, 1,2,4-butanetriol, 1,2,5-pentane triol, glycerol, 2-methylpropane triol, 2-methyl-1,2,4-butane triol, trimethylol ethane, trimethylol propane, and 1,3,5-trihydroxy methyl benzene.

As the trivalent or higher alcohol, sorbitol, 1,4-sorbitan, pentaerythritol, glycerol, and trimethylol propane are preferable.

These bivalent or higher alcohols may be used singly or in combination of two or more types.

Examples of the bivalent carboxylic acid include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, and succinic acid substituted with an alkyl group or an alkenyl group. As the succinic acid substituted with an alkyl group or an alkenyl group, succinic acid substituted with an alkyl group or an alkenyl group which has 2 to 20 carbon atoms is exemplified. Examples of such succinic acid include n-dodecenyl succinic acid and n-dodecyl succinic acid. Acid anhydride of the bivalent carboxylic acid or ester of the bivalent carboxylic acid may be used.

As the bivalent carboxylic acid, maleic acid, fumaric acid, terephthalic acid, and succinic acid substituted with an alkenyl group which has 2 to 20 carbon atoms are preferable.

Examples of trivalent or higher carboxylic acid include 1,2,4-benzenetricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylene carboxy propane, 1,2,4-cyclohexane tricarboxylic acid, tetra(methylene carboxyl) methane, 1,2,7,8-octane tetracarboxylic acid, pyromellitic acid, Empol trimer acid, and acid anhydride or ester of the above substances.

As the trivalent or higher carboxylic acid, 1,2,4-benzenetricarboxylic acid (trimellitic acid), acid anhydride thereof or lower (carbon atoms of 1 to 12) alkyl ester thereof is preferable.

These bivalent or higher carboxylic acids may be used singly or in combination of two or more types.

When bivalent or higher alcohol and bivalent or higher carboxylic acid are polycondensed, a catalyst may be used in order to accelerate the reaction. Examples of the catalyst include dibutyltin oxide, titanium compounds, dialkoxy tin (II), tin oxide (II), a fatty acid tin (II), tin dioctoate (II), and distearate tin (II).

The crystalline polyester resin will be described.

As the crystalline polyester resin, a substance obtained by polycondensing bivalent or higher alcohol and bivalent or higher carboxylic acid is exemplified.

Examples of the bivalent or higher alcohol include ethylene glycol, 1,2-propylene glycol, 1,3-propylene glycol, 1,4-butanediol, 1,5-pentanediol, 1,6-hexanediol, neopentyl glycol, 1,4-butenediol, poly oxypropylene, polyoxyethylene, glycerin, pentaerythritol, and trimethylolpropane. As the bivalent or higher alcohol, 1,4-butanediol and 1,6-hexanediol are preferable.

Examples of the bivalent or higher carboxylic acid include adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, succinic acid substituted with an alkyl group or an alkenyl group, cyclohexane dicarboxylic acid, trimellitic acid, pyromellitic acid, and acid anhydride or ester of the above substances. As the succinic acid substituted with an alkyl group or an alkenyl group, succinic acid substituted with an alkyl group or an alkenyl group which has 2 to 20 carbon atoms is exemplified. Examples of such succinic acid include n-dodecenyl succinic acid and n-dodecyl succinic acid. Among these substances, fumaric acid is preferable.

An endothermic peak temperature of the crystalline polyester resin, which is measured by a differential scanning calorimeter (DSC) is not particularly limited. However, a range of 78° C. to 110° C. is preferable, a range of 80° C. to 107° C. is more preferable, and a range of 83° C. to 105° C. is further preferable. If the endothermic peak temperature is excessively low, when being combined with the ester wax, durability and long-life characteristics of a toner may be degraded. If the endothermic peak temperature is excessively high, fixing of the toner may be degraded.

The content of the crystalline polyester resin is not particularly limited. However, a range of 3 wt % to 32 wt % with respect to the total mass of toner particles is preferable, a range of 5 wt % to 30 wt % is more preferable, and a range of 7 wt % to 28 wt % is further preferable.

If the content of the crystalline polyester resin is equal to or greater than 3 wt % with respect to the total mass of the toner particles, low-temperature offset resistance is easily improved. If the content of the crystalline polyester resin is equal to or smaller than 32 wt % with respect to the total mass of the toner particles, storage properties under a high temperature environment are easily improved.

The ester wax will be described.

The ester wax in the embodiment includes two or more ester compounds each of which is represented by the following general formula (I) and have different number of carbon atoms.

$$R^1COOR^2 \quad (I)$$

The $R^1$ and $R^2$ in the formula (I) are each independently an alkyl group. The total number of carbon atoms of $R^1$ and $R^2$ is 31 to 53.

An ester compound among the two or more ester compounds may have a number ($C_{n1}$) of carbon atoms of 40 to 44.

The ester wax satisfies the following formula (1).

$$1.03 \leq b/a \leq 1.61 \quad (1)$$

The "a" in the formula (1) indicates the content (wt %) of the ester compound having the number ($C_{n1}$) of carbon atoms. The "b" indicates the total content (wt %) of ester compounds which have the number of carbon atoms of 40 to 44.

The "b/a" is from 1.03 to 1.61. The durability and the long-life characteristics are improved by causing "b/a" to be in the range. Particularly, the durability and the long-life characteristics when the ester wax in the embodiment is combined with the crystalline polyester resin are improved. The "b/a" is preferably 1.03 to 1.58, and more preferably 1.03 to 1.55.

The ester wax satisfies the following formula (2).

$$0.06 \leq c/a \leq 0.90 \quad (2)$$

The "a" in the formula (2) is the same as "a" in the formula (1). The "c" in the formula (2) indicates the total content (wt %) of ester compounds which have the number of carbon atoms being greater than 44.

The "c/a" is 0.06 to 0.90. The durability and the long-life characteristics are improved by causing "c/a" to be in the range. Particularly, the durability and the long-life characteristics when the ester wax in the embodiment is combined with the crystalline polyester resin are improved. If "c/a" is smaller than 0.06, the ester wax is precipitated from a toner particle when being left at a high temperature. Thus, durability is deteriorated.

From a viewpoint of improving the low-temperature toner fixing, the durability, and the long-life characteristics, "c/a" is preferably from 0.06 to 0.86, more preferably 0.07 to 0.80, and further preferably from 0.08 to 0.78.

The "a" is preferably in a range of 55 wt % to 90 wt %, more preferably in a range of 56 wt % to 89 wt %, and further preferably in a range of 56 wt % to 88 wt %.

The "b" is preferably in a range of 56.7 wt % to 93.7 wt %, more preferably in a range of 58 wt % to 93 wt %, and further preferably in a range of 60 wt % to 92 wt %.

The "c" is preferably in a range of 3.3 wt % to 49.5 wt %, more preferably in a range of 4 wt % to 49 wt %, and further preferably in a range of 5 wt % to 45 wt %.

If "a", "b", and "c" are respectively in the preferable ranges, "b/a" and "c/a" of the ester wax are easily adjusted, and a toner which is excellent in durability and long-life characteristics is easily obtained.

The content of an ester compound of which the number of carbon atoms is smaller than 40, in the ester wax is preferably in a range of 0.1 wt % to 10 wt % with respect to the total mass of the ester wax, more preferably in a range of 0.1 wt % to 8 wt %, and further preferably in a range of 0.1 wt % to 5 wt %. If the content of the ester compound of which the number of carbon atoms is smaller than 40 is equal to or smaller than the upper limit value, precipitation of the ester wax onto the surface of a toner particle when being left at a high temperature is suppressed and the durability of a toner is improved more.

Preferably, the ester wax in the embodiment has two maximum values of the first maximum value and the second maximum value when distribution of carbon atoms of ester compounds constituting the ester wax (that is, content ratio of the ester compounds having the corresponding number of carbon atoms) is measured by, for example, FD-MS (which will be described later). Here, the first maximum value corresponds to "a" for the ester compounds of which the number of carbon atoms is from 40 to 44. That is, the first maximum value of the ester wax is at a carbon number in a range of 40 to 44. The second maximum value corresponds to "d" which is the maximum content of an ester compound among the ester compounds of which the number of carbon atoms is greater than 44. If the ester wax has such distribution of carbon atoms, more improvement of the durability and the long-life characteristics is easily obtained.

An ester compound of which the number of carbon atoms is in a predetermined range may or may not be present. The predetermined range is between the number ($C_{n1}$), and the number ($C_{m1}$) of carbon atoms of the ester compound having a number of carbon atoms greater than 44. That is, the predetermined range is greater than $C_{n1}$ and smaller than $C_{m1}$.

In a case where ester compounds of which the number of carbon atoms is greater than $C_{n1}$ and smaller than $C_{m1}$ are in the ester wax, the content of at least one ester compound among the ester compounds of which the number of carbon atoms is greater than $C_{n1}$ and smaller than $C_{m1}$ may be smaller than the content (d) of the ester compound having the number of carbon atoms of $C_{m1}$. The content of all ester compounds having the number of carbon atoms which is greater than $C_{n1}$ and smaller than $C_{m1}$ may be smaller than "d".

A difference between $C_{m1}$ and $C_{n1}$ is preferably equal to or greater than 4, and more preferably equal to or greater than 6. If the difference between $C_{m1}$ and $C_{n1}$ is equal to or greater than the lower limit value, the low-temperature fixing, the durability, and the long-life characteristics are further improved.

The difference between $C_{m1}$ and $C_{n1}$ is preferably equal to or smaller than 8. If the difference between $C_{m1}$ and $C_{n1}$ is equal to or smaller than the upper limit value, the low-temperature fixing, the durability, and the long-life characteristics are further improved.

From a viewpoint of further improving the low-temperature fixing, the durability, and the long-life characteristics, the difference between $C_{m1}$ and $C_{n1}$ is preferably in a range of 4 to 8, more preferably in a range of 6 to 8, and further preferably 6.

$C_{m1}$ is preferably in a range of 46 to 52, more preferably in a range of 46 to 50, and further preferably in a range of 46 to 48. If $C_{m1}$ is in the above range, the low-temperature fixing, the durability, and the long-life characteristics are further improved.

The "d" is preferably in a range of 2 wt % to 25 wt %, and more preferably in a range of 4 wt % to 20 wt %. If "d" is in the preferable range, good balance between the low-temperature fixing, the durability, and the long-life characteristics is easily obtained. The "d" preferably indicates the second largest content after "a" in the ester wax.

The endothermic peak temperature (melting temperature) of the ester wax, which is measured by a differential scanning calorimeter, is not particularly limited. However, the endothermic peak temperature is preferably from 60° C. to 75° C., more preferably from 62° C. to 73° C., and further preferably from 63° C. to 72° C. If the endothermic peak temperature is excessively high, low-temperature fixing may be degraded. If the endothermic peak temperature is excessively low, the durability and the long-life characteristics may be degraded.

The content of the ester wax is not particularly limited. However, a range of 3 wt % to 13 wt % with respect to the total mass of the toner particles is preferable, a range of 5 wt % to 12 wt % is more preferable, and a range of 6 wt % to 11 wt % is further preferable. If the content of the ester wax is equal to or greater than 3 wt % with respect to the total mass of the toner particles, the low-temperature offset resistance and high-temperature offset resistance are easily improved. If the content of the ester wax is equal to or smaller than 13 wt % with respect to the total mass of the toner particles, scattering of a toner, fixing of the toner onto a photoreceptor, and storage properties under a high temperature environment are easily improved.

The content of the ester compound having the corresponding number of carbon atoms in the ester wax is measured by mass analysis with field desorption mass spectrometry (FD-MS), for example. Ionic strength of each of the ester compounds having the corresponding number of carbon atoms in the ester wax is obtained through measurement with the FD-MS, and the total ionic strength of the ester compounds is set to 100. A relative value of the ionic strength of each of the ester compounds having the corresponding number of carbon atoms to the total ionic strength is calculated. The calculated relative value is set as the content of the ester compound having the corresponding number of carbon atoms in the ester wax. The number of carbon atoms of an ester compound of which the relative value is the largest is set as $C_{n1}$. The number of carbon atoms of an ester compound of which the relative value is the largest among ester compounds of which the number of carbon atoms is greater than 44 is set as $C_{m1}$.

The ester wax in the embodiment may be obtained by synthesis by esterification of long-chain alkyl carboxylic acid and long-chain alkyl alcohol. As the long-chain alkyl carboxylic acid, alkyl carboxylic acid having 8 to 40 carbon atoms is preferable, and alkyl carboxylic acid having 10 to 30 carbon atoms is more preferable. Examples of the long-chain alkyl carboxylic acid include palmitic acid, stearic acid, arachidonic acid, behenic acid, lignoceric acid, cerotic acid, and montanic acid. As the long-chain alkyl alcohol, alkyl alcohol having a range of 8 to 40 carbon atoms is preferable and alkyl alcohol having a range of 10 to 30 carbon atoms is more preferable. Examples of the long-chain alkyl alcohol include palmityl alcohol, stearyl alcohol, arachidyl alcohol, behenyl alcohol, lignoceryl alcohol, ceryl alcohol, and montanyl alcohol.

Regarding a rice wax, a carnauba wax, or the like which is used in the related art, the number of carbon atoms of an ester compound which is contained in the maximum content is large. Such a wax has poor low-temperature fixing.

The ester compounds which are used in the embodiment and constitute the ester wax have the above-described distribution of carbon atoms. Thus, the ester wax in the embodiment is dispersed well in a toner particle. A toner containing the ester wax has low glass-transition temperature (Tg), and thus has good fixing at a low temperature.

In a case where the crystalline polyester resin is used as the binder resin, the low-temperature fixing is easily improved, but dispersibility of the colorant is deteriorated. In the ester wax according to the embodiment, $C_{n1}$ is in a range of 40 to 44, and "b/a" is in a range of 1.03 to 1.61. Distribution of carbon atoms of ester compounds which constitute the ester wax and have the small number of carbon atoms is sharp. Thus, the ester wax in the embodiment has a low melting temperature and low molten viscosity. Accordingly, the ester wax can easily wet a surface of the colorant when the colorant is dispersed, and dispersibility of the colorant is improved. In addition, the low-temperature toner fixing is improved. Since precipitation of the colorant onto the surface of a toner particle is suppressed, and thus charge stability is improved, it is possible to hold a high quality image for a long term.

In the ester wax according to the embodiment, "c/a" is in a range of 0.06 to 0.90, and ester compounds which constitute the ester wax and have the large number of carbon atoms have distribution of carbon atoms. Thus, the dispersibility of the ester wax is improved, and precipitation of the ester wax onto the surface of a toner particle is suppressed. In addition, a portion of the ester wax containing the colorant is easily diffused into the binder resin. Thus, the toner according to the embodiment is excellent in durability and long-life characteristics.

The toner particle according to the embodiment may contain other components, if necessary, in addition to the colorant, the binder resin, and the ester wax. As the other components, a charge-controlling agent, a surfactant, a basic compound, an aggregating agent, a pH adjusting agent, and the like are exemplified.

The charge-controlling agent will be described.

The charge-controlling agent controls an electrification property of a toner, and is used for easily transferring the toner onto a recording medium such as a sheet. Examples of the charge-controlling agent include metal-containing azo compounds, metal-containing salicylic acid derivative compounds, substances obtained by performing a treatment on metal oxide with a hydrophobizing agent, and inclusion compounds of polysaccharide.

Among the metal-containing azo compounds, a complex or a complex salt in which the metal is iron, cobalt, or chromium, or a mixture thereof is preferable. Among the metal-containing salicylic acid derivative compounds, and the substances obtained by performing a treatment on metal oxide with a hydrophobizing agent, a complex or a complex salt in which the metal is zirconium, zinc, chromium or boron, or a mixture thereof is preferable. Among the inclusion compounds of polysaccharide, an inclusion compound of polysaccharide, which contains aluminum and magnesium, is preferable.

The content of the charge-controlling agent is not particularly limited. However, 0.5 parts by mass to 3 parts by mass with respect to 100 parts by mass of the binder resin maybe set. If the added amount of the charge-controlling agent is smaller than 0.5 parts by mass, a charged amount of a developer is small, and thus toner scattering in the device may be reduced and the long-life characteristics may be degraded. If the added amount of the charge-controlling agent is greater than 3 parts by mass, the charged amount of the developer is large, and thus image density may become insufficient. In addition, stain may occur on surfaces of carriers in the developer, and thus charging may become unstable.

A producing method of a toner particle will be described.

A toner particle according to the embodiment may be produced by using, for example, a kneading and pulverization method or a chemical method. As the producing method of the toner particle according to the embodiment, the kneading and pulverization method is preferable.

As the kneading and pulverization method, for example, a producing method which includes a mixing process, a kneading process, and a pulverizing process is exemplified. In the mixing process, a colorant, a binder resin, and an ester wax are mixed, thereby obtaining a mixture. In the kneading process, the mixture is molten-kneaded, thereby obtaining a kneaded mixture. In the pulverizing process, the kneaded mixture is pulverized, thereby obtaining a pulverized material. The producing method may include, if necessary, a classifying process in which the pulverized material is classified.

In the mixing process, raw materials of the toner particle are mixed so as to form a mixture. Examples of a mixer used in the mixing process include a Henschel mixer (manufactured by Nippon coke & engineering Co., Ltd.); Super Mixer (manufactured by Kawata MFG Co., Ltd.); Ribocone (manufactured by Okawara MFG Co., Ltd.); Nauta Mixer, a Turbulizer, and Cyclomix (manufactured by Hosokawa Micron Corporation); Spiral Pin Mixer (manufactured by Pacific Machinery & Engineering Co., Ltd); and Loedige Mixer (manufactured by Matsubo Corporation).

In the kneading process, the mixture which is formed in the mixing process is molten-kneaded so as to form a kneaded mixture. Examples of a kneading machine used in the kneading process include KRC Kneader (manufactured by Kurimoto Ltd.); Buss Ko-Kneader (manufactured by Buss Corporation); a TEM extruder (manufactured by Toshiba Machine Co., Ltd); a TEX biaxial kneader (manufactured by Japan Steel Works, LTD); a PCM kneader (manufactured by Ikegai Corporation) ; a three roll mill, a mixing roll mill, and a kneader (manufactured by Inoue MFG Inc.); Kneadex (manufactured by Nippon coke & engineering Co., Ltd.); a MS type pressure kneader, and a kneader-ruder (manufactured by Moriyama manufacturing Corporation); and a Banbury mixer (manufactured by Kobe Steel, Ltd.).

In the pulverizing process, the kneaded mixture which is formed in the kneading process is pulverized so as to form a pulverized material. Examples of a pulverizer used in the pulverizing process include a hammer mill, a cutter mill, a jet mill, a roller mill, and a ball mill. The pulverized material which is obtained by the pulverizer may be more finely pulverized. Examples of a pulverizer which more finely pulverizes the pulverized material include a counter jet mill, Micron jet, and Innomizer (manufactured by Hosokawa Micron Corporation); an IDS mill, and a PJM jet pulverizer (manufactured by Nippon Pneumatic Mfg. Co., Ltd.); Cross jet mill (manufactured by Kurimoto Ltd.); Ulmax (manufactured by Nisso Engineering Co., Ltd); SK Jet-O-mill (manufactured by Seishin Enterprise Co., Ltd.); Kryptron (manufactured by Kawasaki Heavy Industries, Ltd.); and Turbo mill (manufactured by Freund-Turbo Corporation). The pulverized material obtained in the pulverizing process may be used itself as a toner particle, or, if necessary, may be subjected to the classifying process so as to be used as the toner particle.

In the classifying process, a pulverized material which is obtained in the pulverizing process is classified. Examples of a classifier used in the classifying process include Classiel, a micron classifier, and a Spadic classifier (manufactured by Seishin Enterprise Co., Ltd.); a turbo classifier (manufactured by Nisshin Engineering Co., Ltd); a micron separator, Turboplex (ATP), and a TSP separator (manufactured by Hosokawa Micron Corporation); Elbow-Jet (manufactured by Nittetsu Mining Co., Ltd.); Dispersion separator (manufactured by Nippon Pneumatic Mfg. Co., Ltd.); and YM microcut (manufactured by Yasukawa Corporation).

As the kneading and pulverization method, for example, the following methods are exemplified in addition to the above method. A colorant, a binder resin, and an ester wax are mixed so as to form a mixture. The mixture is molten and kneaded so as to form a kneaded mixture. The kneaded mixture is pulverized so as to form medium-pulverized particles which are coarsely granulated. The medium-pulverized particles are mixed with an aqueous medium, thereby a liquid mixture is prepared. Mechanical shearing is applied to the liquid mixture so as to form fine-particle dispersion. Fine particles are aggregated in the fine-particle dispersion, and thereby obtaining toner particles.

The toner particle produced in this manner may be used itself as a toner or may be mixed with an external additive, if necessary, and be used as a toner.

The external additive will be described.

The external additive is added in order to improve liquidity and an electrification property of a toner, and stability thereof during a period when being stored. As the external additive, a particle formed of inorganic oxide is exemplified. Examples of the inorganic oxide include silica, titania, alumina, strontium titanate, and tin oxide. The particle formed of the inorganic oxide may be subjected to surface treatment with a hydrophobizing agent, from a viewpoint of improvement of stability.

A volume average particle diameter of a group of particles formed of the inorganic oxide is not particularly limited, but is preferably in a range of 8 nm to 200 nm. If the volume average particle diameter of the group of particles is smaller than the lower limit value, transfer efficiency of a toner to a transfer belt or a sheet may be lowered. If the volume average particle diameter of the group of particles is greater than the upper limit value, a photoreceptor may be damaged, for example.

The external additive may be used singly or in combination of two or more types.

An added amount of the external additive is not particularly limited, but is preferably in a range of 0.2 wt % to 8.0 wt % with respect to the total mass of a toner. The particles formed of inorganic oxide may be added to the toner and fine resin particles of 1 μm or smaller maybe added further.

An adding method of the external additive will be described.

The external additive is mixed with toner particles by a mixer, for example. As the mixer, a mixer which is the same as a mixer used in the producing method of a toner particle is exemplified.

Regarding the external additive, if necessary, coarse particles or the like may be sieved by a sieving machine. Examples of the sieving machine include Ultrasonic (manufactured by Koei Sangyo Co., Ltd.); Resonasieve and a Gyro Sifter (manufactured by Tokuju Co., LTD); Vibrasonic System (manufactured by Dalton Corporation); Soniclean (manufactured by Sintokogio, LTD.); a turbo screener (manufactured by Freund-Turbo Corporation); a microsifter (manufactured by Makino MFG Co., Ltd) ; and a circular vibration sieving machine.

The toner in the embodiment is used as a single-component developer or as a two-component developer obtained by mixing with a carrier.

A developer containing the toner according to the embodiment is not particularly limited. However, since the developer is excellent in the long-life characteristics in addition to the low-temperature fixing and the durability, the developer is appropriately used as a recycled toner. That is, in an image forming apparatus, after an image is formed, the developer is recollected, replenished to a developing device, and thus can be reused.

An example of the image forming apparatus that reuses the recollected toner will be described with reference to FIG. 1.

In FIG. 1, the reference sign of 101 indicates a copier body. An image forming unit 101A is provided on one side portion at the center of the copier body 101. The image forming unit 101A includes a photoreceptor drum 102 which is rotatable in a direction indicated by an arrow, and functions as an image carrier. A charging charger 103, a laser unit 104, a developing device 105, a transfer charger 106, and a cleaning device 107 are sequentially provided around the photoreceptor drum 102 in a rotation direction of the photoreceptor drum 102. The charging charger 103 charges a surface of the photoreceptor drum 102. The laser unit 104 functions as an image forming section that forms an electrostatic latent image on the surface of the photoreceptor drum 102. The developing device 105 functions as a developing section that develops the electrostatic latent image on the photoreceptor drum 102 by using a toner. The transfer charger 106 functions as a transfer section that transfers a toner image on the photoreceptor drum 102, onto a sheet. The cleaning device 107 functions as a removal unit that removes the residual toner on the photoreceptor drum 102.

Figure 2:
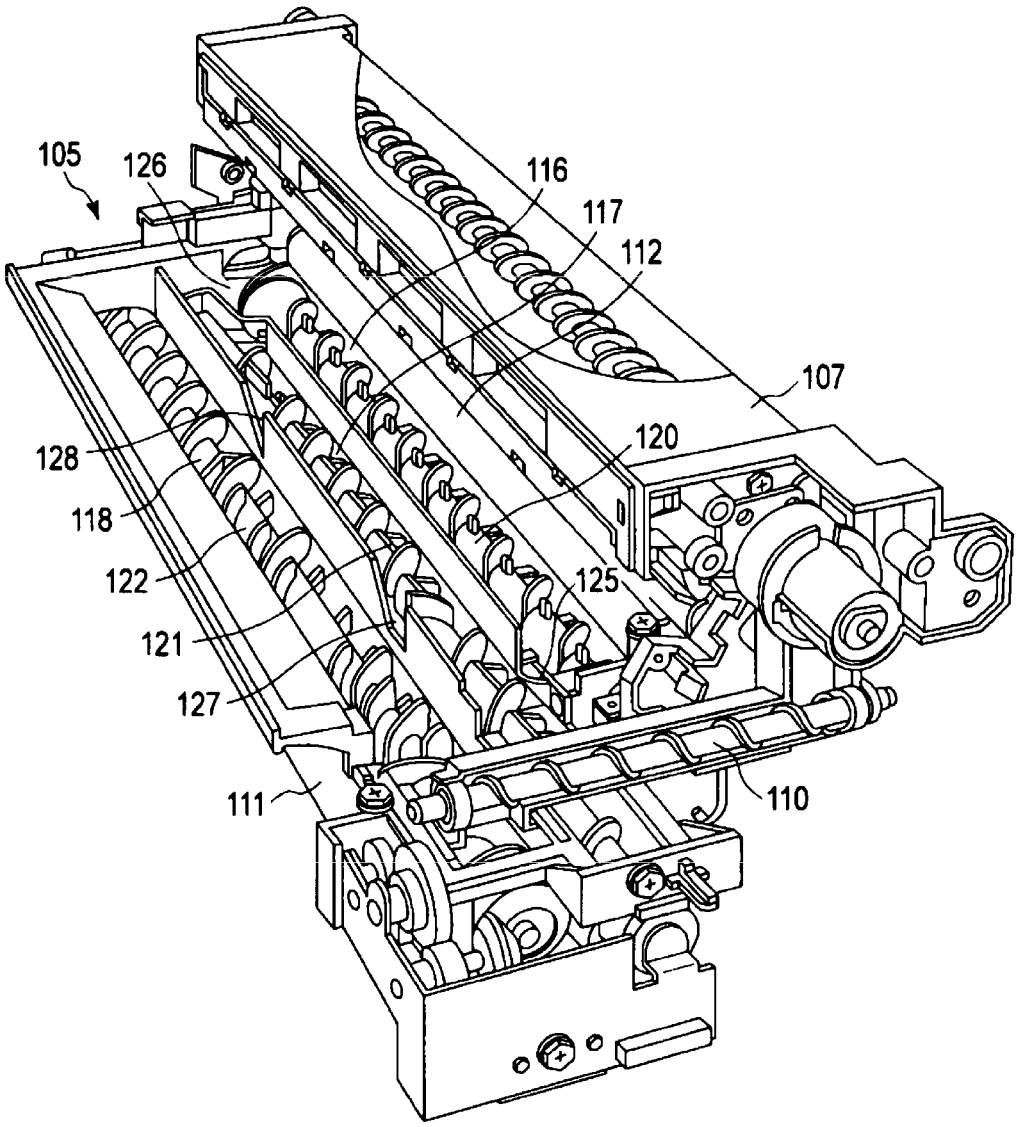
FIG. 2 is a perspective view illustrating a developing device of the image forming apparatus in FIG. 1.

A toner replenishing device 108 is provided as a replenishing section, over the developing device 105. The developer according to the embodiment is stored in the developing device 105, and the developing device 105 is connected to the cleaning device 107 through a recollection mechanism 110 which functions as a recollection section, as illustrated in FIG. 2.

An auger is used for transporting a toner, in the recollection mechanism 110. As the cleaning device 107, a known cleaning blade, a known cleaning brush, or the like is used.

A document placing stand 135 is provided on an upper surface portion of the copier body 101. A scanner 136 is provided on a lower portion side of the document placing stand 135. The scanner 136 exposes an original document on the document placing stand 135. The scanner 136 includes a light source 137, a first reflective mirror 138, a second reflective mirror 139, a third reflective mirror 140, and a light-receiving element 141. The light source 137 irradiates an original document with light. The first reflective mirror 138 reflects light which is reflected from the original document, in a predetermined direction. The second reflective mirror 139 and the third reflective mirror 140 sequentially reflect light which is reflected from the first reflective mirror 138. The light-receiving element 141 receives light reflected from the third reflective mirror 140.

Sheet feeding cassettes 142 and 143, which form multistages, are provided on a lower portion side of the copier body 101. A sheet is sent from the sheet feeding cassettes 142 and 143. The sheet is transported upwardly through a transportation system 144. A pair of transporting rollers 145 and a pair of registration rollers 146, an image transfer unit, a pair of fixing rollers 147, and a pair of exit rollers 148 are arranged in the transportation system 144.

When an image is formed, an original document on the document placing stand 135 is irradiated with light from the light source 137. The light is reflected from the original document, and is received by the light-receiving element 141 through the first to the third reflective mirrors 138 to 140. Thus, a document image is read out. A surface of the photoreceptor drum 102 is irradiated with a laser beam LB from the laser unit 104, based on read information of the document image. The surface of the photoreceptor drum 102 is charged by the charging charger 103 so as to function as a negative electrode. The irradiation with the laser beam LB from the laser unit 104 causes the photoreceptor drum 102 to be exposed. Thus, a surface potential of the photoreceptor drum 102 in an area corresponding to an image portion of the original document is closer to 0 in accordance with density of an image, and an electrostatic latent image is formed. Rotation of the photoreceptor drum 102 causes the electrostatic latent image to face the developing device 105, and a toner which is supplied through a carrier is attracted at the facing position, thereby a visible image is obtained.

At this time, a sheet is fed and transported from the sheet feeding cassette 142 or 143, and a position thereof is adjusted by the registration roller 146. Then, the sheet is fed to the image transfer unit between the transfer charger 106 and the photoreceptor drum 102, and thus the visible image on the photoreceptor drum 102 is transferred onto the sheet.

The sheet onto which the image is transferred is transported to the pair of fixing rollers 147. The sheet is pressed and heated by the pair of fixing rollers 147 so as to fix the image to the sheet. The developer in the embodiment is excellent in low-temperature fixing and allows fixing at a temperature of about 140° C. or lower, for example. After the fixing, the sheet is caused to exit onto an exit tray 150 through the pair of exit rollers 148.

The toner which remains on the surface of the photoreceptor drum 102 without transfer onto the sheet by the above-described image transfer unit is removed by the cleaning device 107. Then, the recollection mechanism 110 brings the removed toner back to the developing device 105, and the toner is reused. If the toner in the developing device 105 is consumed through the above-described developing, a toner is replenished from a toner replenishment container 108.

Next, the above-described developing device 105 will be described with reference to FIGS. 2 and 3.

The developing device 105 includes a developing container 111. A developing roller 112 is provided so as to be rotatable in the developing container 111. The developing roller 112 faces a lower surface portion of the photoreceptor drum 102, and rotation of the developing roller 112 causes a developer to be supplied to the photoreceptor drum 102.

The inside of the developing container 111 is partitioned into a first to a third chambers 116, 117, and 118 by using partition walls 114 and 115 which respectively function as a first and a second partition member. The first to the third chambers 116, 117, and 118 are substantially parallel with each other in a shaft direction of the photoreceptor drum 102. A first mixer 120 as a first agitating and transporting member is provided in the first chamber 116. A second mixer 121 as a second agitating and transporting member is provided in the second chamber 117. A third mixer 122 as a third agitating and transporting member is provided in the third chamber 118.

Rotation of the first mixer 120 causes the developer to be agitated and transported in a first direction (indicated by an arrow in FIG. 3) from one end portion side of the first mixer 120 toward another end portion side, and thus the developer is supplied to the developing roller 112. The second and third mixers 121 and 122 cause the developer to be agitated and transported in a second direction (indicated by an arrow in FIG. 3) which is reverse to the first direction, and thus the developer is fed to the one end portion side of the first mixer 120.

The second and third mixers 121 and 122 are rotationally driven by a driving unit. That is, the driving unit includes a driving motor 162 as a single driving source, and a drive gear 163 rotated by the driving motor 162. A rotation shaft 151 (which will be described later) of the third mixer 122 is connected to the drive gear 163 through a power transmission gear 164 having a large diameter. A rotation shaft 121*a* of the second mixer 121 is connected to the power transmission gear 164 having a large diameter, through a power transmission gear 165 having a small diameter.

With such a configuration, a developer transporting rate of the third mixer 122 is lowered so as to be about ⅙ of a developer transporting rate of the second mixer 121. An agitation-transporting period of the developer by the third mixer 122 is longer than an agitation-transporting period of the developer by the second mixer 121.

The second and third mixers 121 and 122 may be individually rotationally driven by a plurality of driving motors which have different rotation speeds from each other.

The third mixer 122 may include a backward feeding blade which causes the recollected toner to be transported in a direction reverse to the second direction, and thus a transporting rate of the recollected toner may be slower than the developer transporting rate by the second mixer 121.

Next, a developing operation of the developing device 105 will be described.

Figure 3:
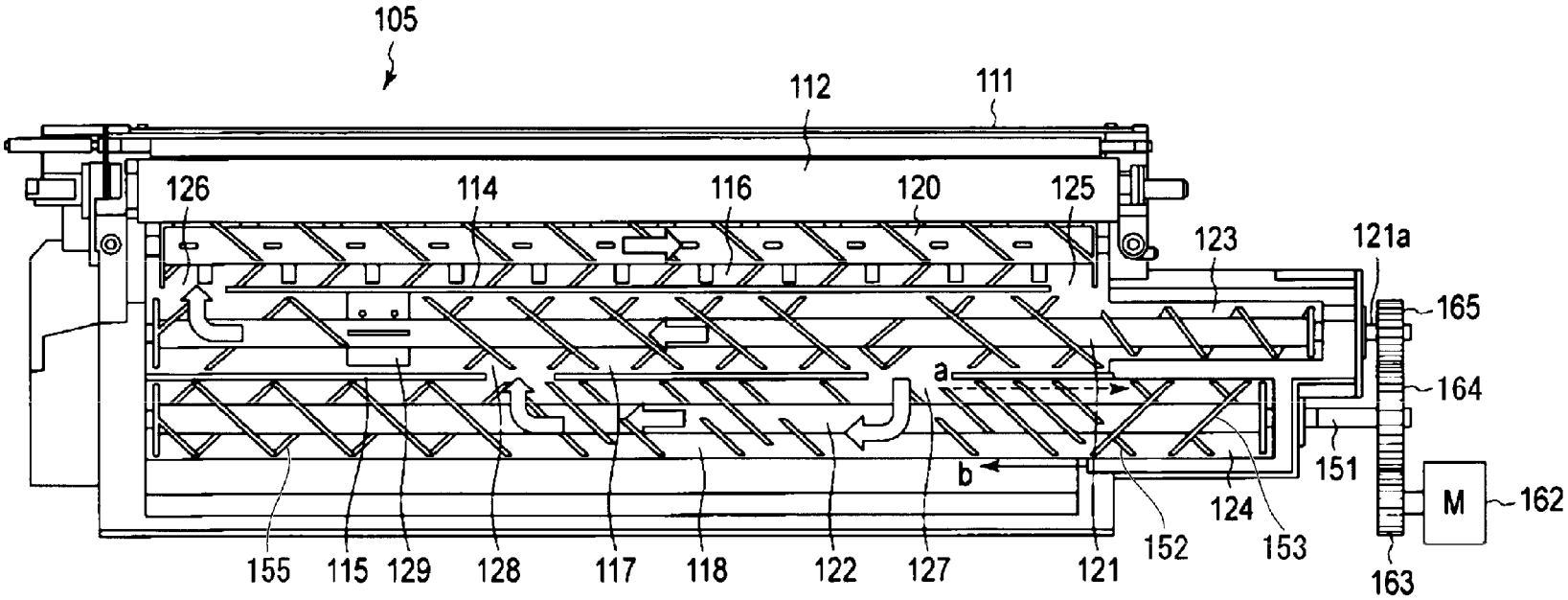
FIG. 3 is a perspective view illustrating the developing device of the image forming apparatus in FIG. 1.

As illustrated in FIG. 3, the rotation of the first mixer 120 causes the developer to be agitated and transported in the first direction, that is, as indicated by the arrow, from the one end portion side of the first mixer 120 toward another end portion side thereof, and thus the toner is supplied to the developing roller 112. The developer is supplied to an electrostatic latent image on the photoreceptor drum 102 by rotation of the developing roller 112, and thus, the electrostatic latent image is visualized.

The developer discharged from the first mixer 120 is guided into the second chamber 117 through a first communication portion 125 of the first partition wall 114. The guided developer is transported in the direction (second direction) which is indicated by the arrow, by the rotation of the second mixer 121. The developer discharged from the second mixer 121 is fed to the one end portion side of the first mixer 120 through a fourth communication portion 126. Thus, the developer is transported so as to be circulated between the first mixer 120 and the second mixer 121.

A portion of the developer which is discharged by the second mixer 121 is fed into the third chamber 118 from a second communication portion 127 of the second partition wall 115, and is transported in the direction (second direction) which is indicated by the arrow. The transported developer is fed again into the second chamber 117 from a third communication portion 128 of the second partition wall 115. The fed developer is agitated and transported by the second mixer 121, and is fed to the one end portion side of the first mixer 120 through the fourth communication portion 126.

Regarding the developer which is agitated and transported by the above-described second mixer 121, a toner density detector 129 detects toner density of the developer. If the toner density which is detected by the toner density detector 129 is equal to or smaller than a predetermined value, a toner is replenished from the toner replenishing device 108. The replenished toner is dropped into a fresh toner reception portion 123 of the developing container 111. The rotation of the second mixer 121 causes the fresh toner to be agitated and transported in the direction (second direction) indicated by the arrow. Thus, similarly to the above descriptions, the fresh toner is fed to the one end portion side of the first mixer 120.

The toner recollected from the cleaning device 107 by the recollection mechanism 110 is dropped to a recycled toner reception portion 124. The rotation of the third mixer 122 causes the recycled toner to be transported in the direction (second direction) indicated by the arrow. At this time, rotation of the backward feeding blade 153 of the third mixer 122 causes the developer fed into the third chamber 118 from the second communication portion 127 to be agitated and transported in a reverse direction as indicated by an arrow a, that is, toward the reception portion 124 of the recycled toner. Then, rotation of a forward feeding blade 152 causes the developer to be agitated and transported in the second direction, that is, in a forward direction as indicated by an arrow b. The developer is fed to the one end portion side of the first mixer 120 through the third communication portion 128, similar to the above descriptions.

The developer which is not fed into the second chamber 117 through the third communication portion 128, but fed to a downstream side in the transportation direction is reversely fed by rotation of the backward feeding blade 155, and is brought back to the third communication portion 128. The developer is sent to the second chamber 117 through the third communication portion 128.

In a case where the developer is recycled as described above, stress may cause an inorganic oxide particle to be peeled off from the toner particle, and thus the liquidity of the developer may be degraded. In the developer according to the embodiment, if hydrophobic silica having a small particle diameter, that is, a primary particle diameter of about 8 nm to 35 nm, is externally added to the toner particle, the liquidity of the developer is easily ensured and good developing is easily performed.

Figure 4:
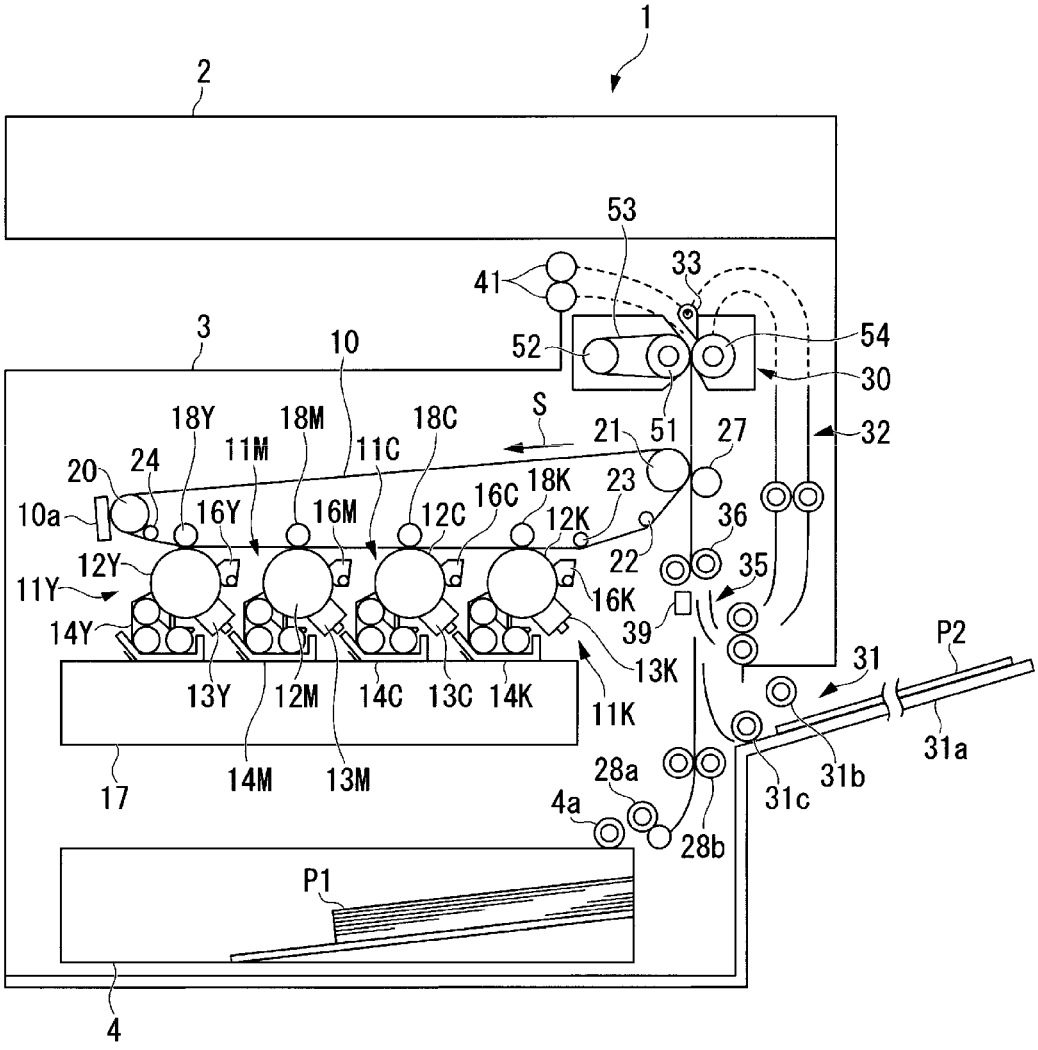
FIG. 4 is a side view illustrating an image forming apparatus according to another embodiment.

A developer containing the toner according to the embodiment may be applied in an image forming apparatus illustrated in FIG. 4. The image forming apparatus illustrated in FIG. 4 has a form in which a toner image is fixed. However, it is not limited to this form. The image forming apparatus may have a form of an ink jet type.

The image forming apparatus 1 illustrated in FIG. 4 is a four-series tandem type color copier MFP (e-studio 4520c). The image forming apparatus 1 includes a scanner unit 2 which is provided at an upper part, and an exit unit 3.

The image forming apparatus 1 includes four image forming stations 11Y, 11M, 11C, and 11K of yellow (Y), magenta (M), cyan (C), and black (K). The four image forming stations 11Y, 11M, 11C, and 11K are disposed along a lower side of an intermediate transfer belt (intermediate transfer medium) 10 so as to be parallel with each other.

The image forming stations 11Y, 11M, 11C, and 11K respectively include photoreceptor drums (image carriers) 12Y, 12M, 12C, and 12K. A charging charger 13Y, a developing device 14Y, and a photoreceptor cleaning device 16Y are disposed around the photoreceptor drum 12Y along a rotation direction which is a direction indicated by an arrow S. A charging charger 13M, a developing device 14M, and a photoreceptor cleaning device 16M are disposed around the photoreceptor drum 12M along a rotation direction which is a direction indicated by an arrow S. A charging charger 13C, a developing device 14C, and a photoreceptor cleaning device 16C are disposed around the photoreceptor drum 12C along a rotation direction which is a direction indicated by an arrow S. A charging charger 13K, a developing device 14K, and a photoreceptor cleaning device 16K are disposed around the photoreceptor drum 12K along a rotation direction which is a direction indicated by an arrow S. A laser exposure device (latent image forming device) 17 applies exposing light to a space from the charging charger 13Y around the photoreceptor drum 12Y to the developing device 14Y, a space from the charging charger 13M around the photoreceptor drum 12M to the developing device 14M, a space from the charging charger 13C around the photoreceptor drum 12C to the developing device 14C, and a space from the charging charger 13K around the photoreceptor drum 12K to the developing device 14K. Thus, an electrostatic latent image is formed on each of the photoreceptor drums 12Y, 12M, 12C, and 12K.

The developing devices 14Y, 14M, 14C, and 14K respectively have two-component developers formed of toners of yellow (Y), magenta (M), cyan (C), and black (K), and a carrier, and respectively supply the toner to electrostatic latent images on the photoreceptor drums 12Y, 12M, 12C, and 12K.

Certain tension is applied to the intermediate transfer belt 10 by a backup roller 21, a driven roller 20, and a first to a third tension roller 22 to 24. The intermediate transfer belt 10 faces and comes into contact with the photoreceptor drums 12Y, 12M, 12C, and 12K. Primary transfer rollers 18Y, 18M, 18C, and 18K are respectively provided in order to primarily transfer toner images on the photoreceptor drums 12Y, 12M, 12C, and 12K onto the intermediate transfer belt 10 at positions in which the intermediate transfer belt 10 faces the photoreceptor drums 12Y, 12M, 12C, and 12K. Each of the primary transfer rollers 18Y, 18M, 18C, and 18K is an electrification roller. A primary transfer bias voltage is applied to the corresponding primary transfer portion.

A secondary transfer roller 27 is disposed at a secondary transfer portion which is supported by the backup roller 21 of the intermediate transfer belt 10, and corresponds to a transfer position. The backup roller 21 corresponds to the electrification roller at the secondary transfer portion, and a predetermined secondary transfer bias is applied to the secondary transfer portion. If a sheet (final transfer medium) which is a print target passes between the intermediate transfer belt 10 and the secondary transfer roller 27, a toner image on the intermediate transfer belt 10 is secondarily transferred onto the sheet. After the secondary transfer is ended, the intermediate transfer belt 10 is cleaned by a belt cleaner 10*a*.

A sheet feeding cassette 4 is provided under the laser exposure device 17. The sheet feeding cassette 4 feeds a sheet P1 in a direction of the secondary transfer roller 27. A manual feed mechanism 31 for manually feeding a sheet P2 is provided on the right side of the image forming apparatus 1.

A pickup roller 4*a*, a separation roller 28*a*, a transporting roller 28*b*, and a pair of registration rollers 36 are provided between the sheet feeding cassette 4 and the secondary transfer roller 27. These rollers constitute a feeding mechanism. A manual pickup roller 31*b* and a manual separation roller 31*c* are provided between a manual feed tray 31*a* of the manual feed mechanism 31 and the pair of registration rollers 36.

A medium sensor 39 which detects the type of a sheet is disposed on a transported path 35. On the transported path 35, the sheet is transported from the sheet feeding cassette 4 or the manual feed tray 31*a* in a direction of the secondary transfer roller 27. In the image forming apparatus 1, the transporting rate, transfer conditions, fixing conditions, or the like of a sheet maybe controlled based on a detection result obtained by the medium sensor 39. A fixing device 30 is provided on a downstream of the secondary transfer portion in a direction of the transported path 35.

A sheet which is extracted from the sheet feeding cassette 4 or is fed from the manual feed mechanism 31 is transported to the fixing device 30 through the pair of registration rollers 36 and the secondary transfer roller 27 along the transported path 35. The fixing device 30 includes a fixing belt 53, and a facing roller 54. The fixing belt 53 is wound around a pair of a heating roller 51 and a driving roller 52. The facing roller 54 is disposed so as to face the heating roller 51 with the fixing belt 53 interposed between the facing roller 54 and the heating roller 51. The sheet having the toner image which is transferred at the secondary transfer portion is introduced between the fixing belt 53 and the facing roller 54, and is heated by the heating roller 51. Thus, the toner image which is transferred onto the sheet is thermally treated and fixed.

The toner in the embodiment is excellent in low-temperature fixing, and thus allows fixing at a temperature of about 125° C. or lower.

A gate 33 is provided on a downstream side of the fixing device 30. Sheets are distributed in a direction of an exit roller 41 or in a direction of a re-transporting unit 32. The sheet directed to the exit roller 41 is ejected to the exit unit 3. The sheet directed to the re-transporting unit 32 is directed again to the direction of the secondary transfer roller 27.

The image forming station 11Y integrally includes the photoreceptor drum 12Y and a process member, and is provided so as to be attachable to the image forming apparatus body. As the process member, at least one of the charging charger 13Y, the developing device 14Y, and the photoreceptor cleaning device 16Y is exemplified. The image forming stations 11M, 11C, and 11K have a configuration similar to that of the image forming station 11Y. Each of the image forming stations 11Y, 11M, 11C, and 11K may be attachable to the image forming apparatus. In addition, the image forming stations 11Y, 11M, 11C, and 11K may be attachable to the image forming apparatus, as an integrated image forming unit 11.

The above-described color copier is a high speed machine and requires the long-life characteristics. However, since the toner in the embodiment causes precipitation of the colorant and the ester wax to the surface of the toner particle to be suppressed, and causes the charge stability to be improved, a high quality image is realized for a long term.

Fixing is performed at a temperature of 135° C. or lower in a monochromatic machine, but is performed at a temperature of 120° C. or lower in a color machine. The reason is because both fixing machines have different configurations. Generally, in the color machine, in order to obtain a superimposed image, a fixing belt type is employed and a nip width is wide. Thus, the color machine has an advantage in low-temperature fixing. In the monochromatic machine, from a viewpoint of low cost, and of not obtaining a superimposed image, a fixing roller type is employed in many cases. In this case, the nip width is narrow when the same pressure is applied. Thus, a desired fixing temperature in the monochromatic machine is set to be higher than a desired fixing temperature of the color machine. Since the toner in the embodiment is excellent in low-temperature fixing, the desired fixing temperature may be lowered by about 10° C. even in the monochromatic machine.

Figure 5:
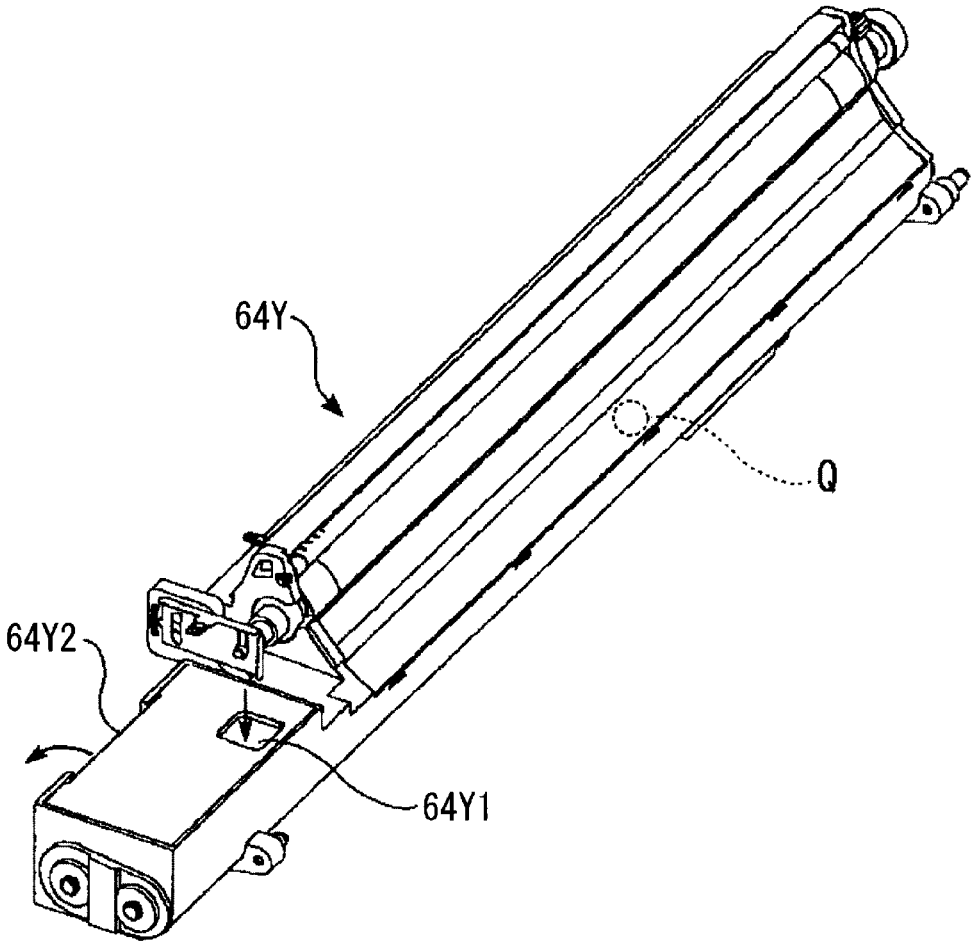
FIG. 5 is a perspective view illustrating a modification example of a developing device of the image forming apparatus in FIG. 4.

A developer containing the toner according to the embodiment may be applied in an image forming apparatus obtained by modifying a portion of the image forming apparatus illustrated in FIG. 4. FIG. 5 illustrates an example in which the developing device 14Y of the image forming apparatus in FIG. 4 is modified.

A developing device 64Y illustrated in FIG. 5 contains a two-component developer which is formed of a yellow toner and a carrier. If density of the yellow toner in the developing device 64Y is reduced, a toner density sensor Q in the developing device 64Y detects the reduction of the density. Then, a yellow toner is replenished from a toner cartridge (not illustrated) in the developing device 64Y, and thus the toner density in the developing device 64Y is maintained to be constant. The carrier is also replenished from the toner cartridge through a developer replenishment port 64Y1, along with the toner. Thus, the toner overflows and is discharged from a developer discharge port 64Y2 as much as being replenished. Accordingly, an amount of the developer in the developing device 64Y is maintained to be constant, and the carrier which is old and deteriorated in the developing device 64Y is gradually replaced with a new carrier.

Similar to the above descriptions, the developing devices 14M, 14C, and 14K in the image forming apparatus of FIG. 4 may be respectively modified so as to be developing devices (not illustrated) 64M, 64C, and 64K. The developing devices 64M, 64C, and 64K have a configuration similar to that of the developing device 64Y, except for using a magenta toner, a cyan toner, and a black toner instead of the yellow toner.

The toner in the embodiment may have the following forms, for example.

[1] There is provided a toner which contains a toner particle which contains a colorant, a binder resin, and an ester wax. The ester wax contains two or more ester compounds which each is represented by the following general formula (I) and have different number of carbon atoms from each other. The number ($C_{n1}$) of carbon atoms of an ester compound among the two or more ester compounds is in a range of 40 to 44, and the ester wax satisfies the following formula (1) and formula (2).

$$R^1COOR^2 \quad (I)$$

The $R^1$ and $R^2$ in the formula (I) each independently is an alkyl group, and the total number of carbon atoms of $R^1$ and $R^2$ is in a range from 31 to 53.

$$1.03 \leq b/a \leq 1.61 \quad (1)$$

The "a" in the formula (1) indicates the content (wt %) of the ester compound having the number ($C_{n1}$) of carbon atoms and "b" indicates the total content (wt %) of ester compounds which have the number of carbon atoms of 40 to 44.

$$0.06 \leq c/a \leq 0.90 \quad (2)$$

The "a" in the formula (2) is the same as "a" in the formula (1), and "c" in the formula (2) indicates the total content (wt %) of ester compounds which have the number of carbon atoms being greater than 44.

[2] In the toner of [1], when the number of carbon atoms of an ester compound contained in the maximum amount among the ester compounds which have the number of carbon atoms being greater than 44 is taken as $C_{m1}$, a difference between $C_{m1}$ and $C_{n1}$ is equal to or greater than 4.

[3] In the toner of [2], the difference between $C_{m1}$ and $C_{n1}$ is in a range from 4 to 8.

[4] In the toner of any one of [1] to [3], "c/a" in the formula (2) is equal to or greater than 0.08.

[5] In the toner of any one of [1] to [4], the content of an ester compound of which the number of carbon atoms is smaller than 40, in the ester wax is in a range from 0.1 wt % to 10 wt % with respect to the total mass of the ester wax.

[6] In the toner of any one of [1] to [5], "a" is in a range from 55 wt % to 90 wt %.

[7] In the toner of any one of [1] to [6], "b" is in a range from 56.7 wt % to 93.7 wt %, and "c" is in a range from 3.3 wt % to 49.5 wt %.

[8] In the toner of any one of [1] to [7], the ester wax has two maximum values of a first maximum value and a second maximum value regarding a content ratio of the ester compounds having the corresponding number of carbon atoms in the ester wax. The first maximum value corresponds to "a", and the second maximum value corresponds to the maximum content of an ester compound among the ester compounds of which the number of carbon atoms is greater than 44.

[9] In the toner of any one of [1] to [8], an ester compound of which the number of carbon atoms is in a predetermined range is not present. The predetermined range is between the number ($C_{n1}$), and the number ($C_{m1}$) of carbon atoms of the ester compound (that is, greater than $C_{n1}$ and smaller than $C_{m1}$) which is contained in the maximum content among the ester compounds of which the number of carbon atoms is greater than 44.

[10] In the toner of any one of [1] to [8], ester compounds of which the number of carbon atoms is greater than $C_{n1}$ and smaller than $C_{m1}$ are present in the ester wax. $C_{m1}$ is the number of carbon atoms of an ester compound which is contained in the maximum amount among the ester compounds of which the number of carbon atoms is greater than 44. The content of at least one ester compound among the ester compounds of which the number of carbon atoms is greater than $C_{n1}$ and smaller than $C_{m1}$ is smaller than the content of the ester compound having the number of carbon atoms of $C_{m1}$.

[11] In the toner of any one of [1] to [10], the binder resin contains a crystalline polyester resin. An endothermic peak temperature of the ester wax, which is measured by a differential scanning calorimeter, is in a range from 60° C. to 75° C., and an endothermic peak temperature of the crystalline polyester resin, which is measured by a differential scanning calorimeter, is in a range from 78° C. to 110° C.

[12] In the toner of [11], the content of the ester wax is 3 wt % to 13 wt % with respect to the total mass of the toner particles, and the content of the crystalline polyester resin is 3 wt % to 32 wt % with respect to the total mass of the toner particles.

EXAMPLES

Hereinafter, the embodiment will be more specifically described by using the following examples.

Ester waxes A to P were prepared as follows.

A preparation example of the ester wax will be described.

First, 80 parts by mass of a long-chain alkyl carboxylic acid component and 20 parts by mass of a long-chain alkyl alcohol component were put into a four-neck flask to which an agitator, a thermopile, and a nitrogen introduction tube were attached. Esterification was performed at 220° C. under a nitrogen gas stream, thereby obtaining a reactant.

Then, a solvent mixture of toluene and ethanol was added to the flask, and thus the reactant was dissolved. A sodium hydroxide aqueous solution was added to the flask and was stirred at 70° C. for 30 minutes. The flask stood for 30 minutes and the contents of the flask were separated into an organic layer and an aqueous layer. The aqueous layer was removed from the contents of the flaks.

Then, ion exchange water was added to the flask, and was stirred at 70° C. for 30 minutes. The flask stood for 30 minutes and the contents of the flask were separated into an organic layer and an aqueous layer. The aqueous layer was removed from the contents of the flaks. Such an operation was repeated five times. A solvent is removed from the organic layer in the contents of the flask, under a decompressed condition, thereby obtaining an ester wax.

Ester waxes A to O formed from ester compounds were prepared by adjusting the types and a mixing ratio of the following long-chain alkyl carboxylic acid component and the following long-chain alkyl alcohol component. Distribution of the number of carbon atoms is different for each of the ester waxes.

The long-chain alkyl carboxylic acid component is as follows.

Palmitic acid ($C_{16}H_{32}O_2$)
Stearic acid ($C_{18}H_{36}O_2$)
Arachidonic acid ($C_{20}H_{40}O_2$)
Behenic acid ($C_{22}H_{44}O_2$)
Lignoceric acid ($C_{24}H_{48}O_2$)
Cerotic acid ($C_{26}H_{52}O_2$)
Montanic acid ($C_{28}H_{56}O_2$)

The long-chain alkyl alcohol component is as follows.

Palmityl alcohol ($C_{16}H_{34}O$)
Stearyl alcohol ($C_{18}H_{38}O$)
Arachidyl alcohol ($C_{20}H_{42}O$)
Behenyl alcohol ($C_{22}H_{46}O$)
Lignoceryl alcohol ($C_{24}H_{50}O$)
Ceryl alcohol ($C_{26}H_{54}O$)
Montanyl alcohol ($C_{28}H_{58}O$)

Regarding the ester waxes A to H, a ratio (b/a) of the total content "b" of ester compounds of which the number of carbon atoms is 40 to 44 in the ester wax, to the content "a" of an ester compound having the number ($C_{n1}$) of carbon atoms in the ester wax is in a range of 1.03 to 1.61. Regarding the ester waxes A to H, a ratio (c/a) of the total content "c" of ester compounds of which the number of carbon atoms is greater than 44 in the ester wax, to "a" is in a range of 0.06 to 0.90.

On the contrary, an ester wax I is prepared in such a manner that, for example, a mixing ratio of behenic acid in the long-chain alkyl carboxylic acid component, and behenyl alcohol in the long-chain alkyl alcohol component is increased, and thus "c/a" is adjusted to be smaller than 0.06. Ester waxes J and K are prepared in such a manner that, for example, a mixing ratio of stearic acid in the long-chain alkyl carboxylic acid component, and stearyl alcohol in the long-chain alkyl alcohol component is increased, and thus "b/a" is adjusted to be greater than 1.61. An ester wax L is prepared in such a manner that, for example, a mixing ratio of arachidonic acid in the long-chain alkyl carboxylic acid component, and arachidyl alcohol in the long-chain alkyl alcohol component is increased, and thus "c/a" is adjusted to be smaller than 0.06. An ester wax M is prepared in such a manner that, for example, a mixing ratio of stearic acid in the long-chain alkyl carboxylic acid component and arachidyl alcohol in the long-chain alkyl alcohol component is increased, and thus the number of carbon atoms of an ester compound which is contained in the maximum content is 38. An ester wax N is prepared in such a manner that, for example, a mixing ratio of arachidonic acid in the long-chain alkyl carboxylic acid component, and arachidyl alcohol in the long-chain alkyl alcohol component is increased, and thus "b/a" is adjusted to be greater than 1.61. An ester wax O is prepared so as to be adjusted by using only behenic acid as the long-chain alkyl carboxylic acid component and using only behenyl alcohol as the long-chain alkyl alcohol component. As an ester wax P, a rice wax (commercial product) is used.

Regarding ester compounds constituting the ester waxes A to P, distribution of carbon atoms (content ratio of ester compounds having the corresponding number of carbon atoms), a melting temperature, an acid value, and a hydroxyl value were measured as follows. Measurement results are shown in Table 1 and Table 2.

A measuring method of the distribution of carbon atoms (content ratio of ester compounds having the corresponding number of carbon atoms) of ester compounds constituting an ester wax will be described.

Regarding the ester compounds constituting an ester wax, the distribution of carbon atoms (content ratio of ester compounds having the corresponding number of carbon atoms) was measured by FD-MS with "JMS-T100GC (manufactured by Jeol Ltd.)". Measurement conditions are as follows.

Concentration of sample: 1 mg/ml (solvent, chloroform)
Cathode voltage: −10 kv
Spectral recording interval: 0.4 s
Measurable mass range: 10 to 2000

The total ionic strength of ester compounds having the corresponding number of carbon atoms, which is obtained through the measurement, is assumed to be 100. A relative value of the ionic strength of each of the ester compounds having the corresponding number of carbon atoms, to the total ionic strength is obtained. The relative value is used as the content ratio of each of the ester compounds having the corresponding number of carbon atoms in the ester wax. The number of carbon atoms of an ester compound of which the relative value is the largest is set as $C_{n1}$. The number of carbon atoms of an ester compound of which the relative value is the largest among ester compounds having the number of carbon atoms which is greater than 44 is set as $C_{m1}$.

A measuring method of the melting temperature will be described.

The melting temperature was measured by a DSC of "DSC Q2000 (manufactured by T.A. Instruments)". Measurement conditions are as follows.

Amount of sample: 5 mg
Lid and pan: alumina
Heating rate: 10° C./min

Measuring method: a sample is heated from 20° C. to 200° C. Then, the sample is cooled until the temperature of the sample is equal to or lower than 20° C. The sample is heated again, and the highest endothermic peak which is measured in a temperature range of 55° C. to about 80° C. is set as the melting temperature of the ester wax.

The melting temperature of the crystalline polyester resin (which will be described later) is measured similar to the above descriptions. However, in this case, a sample is heated again, and the highest endothermic peak which is measured in a temperature range of 75° C. to about 120° C. is set as the melting temperature of the crystalline polyester resin.

A measuring method of the acid value and the hydroxyl value will be described.

The acid value and the hydroxyl value are measured in accordance with JIS K0070.

TABLE 1

| Ester wax | Content ratio of ester compounds having the number of carbon atoms in ester wax (wt %) | | | | | | | | | | | | | | | | | |
|---|---|---|---|---|---|---|---|---|---|---|---|---|---|---|---|---|---|---|
| | C32 | C34 | C36 | C38 | C40 | C42 | C44 | C46 | C48 | C50 | C52 | C54 | C56 | C58 | C60 | C62 | C64 | C66 |
| A | 0 | 0 | 0.2 | 1.8 | 1.5 | 88.8 | 2.3 | 2.8 | 2.4 | 0.2 | 0 | 0 | 0 | 0 | 0 | 0 | 0 | 0 |
| B | 0 | 0 | 0.1 | 1.0 | 88.7 | 2.2 | 0.7 | 5.8 | 1.4 | 0.1 | 0 | 0 | 0 | 0 | 0 | 0 | 0 | 0 |
| C | 0 | 0 | 0.1 | 1.3 | 85.6 | 1.8 | 1.1 | 2.2 | 4.6 | 3.1 | 0.2 | 0 | 0 | 0 | 0 | 0 | 0 | 0 |
| D | 0 | 0 | 0.1 | 0.4 | 18.3 | 58.6 | 1.6 | 2.4 | 16.8 | 1.7 | 0.1 | 0 | 0 | 0 | 0 | 0 | 0 | 0 |
| E | 0 | 0 | 5.8 | 4.0 | 4.6 | 60.3 | 1.9 | 4.7 | 15.6 | 2.9 | 0.1 | 0.1 | 0 | 0 | 0 | 0 | 0 | 0 |
| F | 0 | 0 | 0.1 | 1.9 | 85.6 | 2.4 | 0.6 | 4.9 | 2.4 | 2.0 | 0.1 | 0 | 0 | 0 | 0 | 0 | 0 | 0 |
| G | 0 | 0 | 0.1 | 0.2 | 56.3 | 17.6 | 0.6 | 1.1 | 23.7 | 0.3 | 0.1 | 0 | 0 | 0 | 0 | 0 | 0 | 0 |
| H | 0 | 0 | 0.1 | 2.2 | 56.6 | 2.4 | 1.6 | 13.8 | 22.4 | 0.8 | 0.1 | 0 | 0 | 0 | 0 | 0 | 0 | 0 |
| I | 0 | 0 | 0 | 0.5 | 0.8 | 7.8 | 88.5 | 2.4 | 0 | 0 | 0 | 0 | 0 | 0 | 0 | 0 | 0 | 0 |
| J | 0 | 0 | 5.3 | 6.8 | 13.8 | 27.0 | 40.0 | 2.7 | 4.4 | 0 | 0 | 0 | 0 | 0 | 0 | 0 | 0 | 0 |
| K | 0 | 5.4 | 14.7 | 13.9 | 18.7 | 9.5 | 17.8 | 13.6 | 6.4 | 0 | 0 | 0 | 0 | 0 | 0 | 0 | 0 | 0 |
| L | 0 | 0 | 0.6 | 2.5 | 92.2 | 2.0 | 0.1 | 2.6 | 0 | 0 | 0 | 0 | 0 | 0 | 0 | 0 | 0 | 0 |
| M | 0 | 0 | 4.6 | 79.5 | 2.1 | 0.3 | 2.3 | 9.7 | 1.4 | 0.1 | 0 | 0 | 0 | 0 | 0 | 0 | 0 | 0 |
| N | 0 | 0 | 0 | 5.9 | 12.1 | 23.5 | 45.0 | 6.8 | 4.3 | 2.4 | 0 | 0 | 0 | 0 | 0 | 0 | 0 | 0 |
| O | 0 | 0 | 0 | 0 | 0 | 0 | 100 | 0 | 0 | 0 | 0 | 0 | 0 | 0 | 0 | 0 | 0 | 0 |
| P | 0 | 0 | 0 | 0 | 0 | 0 | 0 | 7.0 | 12.0 | 13.0 | 18.0 | 20.0 | 15.0 | 10.0 | 5.0 | 0 | 0 | 0 |

TABLE 2

| Ester wax | $C_{n1}$ | a | b/a | c/a | $C_{m1}$ | Difference between $C_{n1}$ and $C_{m1}$ | Melting temperature [° C.] | Acid value [mgKOH/g] | Hydroxyl value [mgKOH/g] |
|---|---|---|---|---|---|---|---|---|---|
| A | C42 | 88.8 | 1.04 | 0.061 | C46 | 4 | 70 | 0.1 | 0.4 |
| B | C40 | 88.7 | 1.03 | 0.082 | C46 | 6 | 62 | 0.1 | 0.4 |
| C | C40 | 85.6 | 1.03 | 0.12 | C48 | 8 | 61 | 0.1 | 0.4 |
| D | C42 | 58.6 | 1.34 | 0.36 | C48 | 6 | 64 | 0.1 | 0.4 |
| E | C42 | 60.3 | 1.11 | 0.39 | C48 | 6 | 67 | 0.1 | 0.5 |
| F | C40 | 85.6 | 1.04 | 0.11 | C46 | 6 | 61 | 0.1 | 0.5 |
| G | C40 | 56.3 | 1.32 | 0.45 | C48 | 8 | 64 | 0.1 | 0.4 |
| H | C40 | 56.6 | 1.07 | 0.66 | C48 | 8 | 65 | 0.1 | 0.5 |
| I | C44 | 88.5 | 1.10 | 0.030 | C46 | 2 | 76 | 0.1 | 0.5 |
| J | C44 | 40.0 | 2.02 | 0.18 | C48 | 4 | 65 | 0.1 | 0.5 |
| K | C40 | 18.7 | 2.46 | 1.07 | C46 | 6 | 63 | 0.1 | 0.3 |
| L | C40 | 92.2 | 1.02 | 0.030 | C46 | 6 | 69 | 0.1 | 0.4 |
| M | C38 | 79.5 | 0.06 | 0.14 | C46 | 8 | 59 | 0.1 | 0.2 |
| N | C44 | 45.0 | 1.79 | 0.30 | C46 | 2 | 67 | 0.1 | 0.5 |
| O | C44 | 100 | 1.00 | 0 | — | — | 75 | 0.1 | 0.4 |
| P | C54 | 20.0 | 0 | 5.00 | C54 | 0 | 79 | 6.3 | 15.4 |

Toners of Examples 1 to 31 and Comparative Examples 1 to 14 will be described.

The toners of Examples 1 to 31 and Comparative Examples 1 to 14 were produced as follows by using the ester waxes A to P.

Example 1

The following raw material of a toner particle was put into a Henschel mixer, and was mixed. The mixture was molten and kneaded by a biaxial extruder. The molten-kneaded mixture was cooled, and then was coarsely pulverized by a Hammer mill. The coarsely-pulverized material was finely pulverized by a jet pulverizer. The finely-pulverized material was classified, and thus toner particles were obtained. The volume average particle diameter of the obtained toner particle was 7 μm, and a glass transition temperature (Tg) was 45.1° C.

The composition of the raw materials of the toner particle is as follows.

Amorphous polyester resin: 87 parts by mass

Crystalline polyester resin (endothermic peak temperature (melting temperature): 110° C.): 3 parts by mass Ester wax A: 3 parts by mass Colorant (MA-100): 6 parts by mass Charge-controlling agent (inclusion compound of polysaccharide, which contains aluminum and magnesium): 1 part by mass 100 parts by mass of the toner particles and the following external additive were put and mixed into a Henschel mixer; thereby the toner of Example 1 was produced.

The composition of the external additive is as follows.

Hydrophobic silica A (merchandise name: "RX50", product manufactured by Nippon Aerosil Co., Ltd., average primary particle diameter: 35 nm): 0.2 parts by mass Hydrophobic silica B (merchandise name: "VP SX110", product manufactured by Nippon Aerosil Co., Ltd., average primary particle diameter: 100 nm): 0.8 parts by mass Hydrophobic titanium oxide (merchandise name: "STT-30S", product manufactured by Titan Kogyo, Ltd., average primary particle diameter: 20 nm): 0.5 parts by mass

Example 2

The toner of Example 2 was produced similar to Example 1, except for using the following raw materials of a toner particle, and the following external additive. The volume average particle diameter of the toner particles was 7 μm, and Tg was 45.0° C.

The composition of the raw materials of the toner particle is as follows.

Amorphous polyester resin: 87 parts by mass

Crystalline polyester resin (endothermic peak temperature: 80° C.): 3 parts by mass Ester wax A: 3 parts by mass
Colorant: 6 parts by mass
Charge-controlling agent: 1 part by mass
The composition of the external additive is as follows.
Hydrophobic silica A: 0.2 parts by mass
Hydrophobic silica B: 0.8 parts by mass
Hydrophobic titanium oxide: 0.5 parts by mass Example 3

The toner of Example 3 was produced similar to Example 1, except for using the following raw materials of a toner particle, and the following external additive. The volume average particle diameter of the toner particles was 7 μm, and Tg was 33.7° C.

The composition of the raw materials of the toner particle is as follows.

Amorphous polyester resin: 61.5 parts by mass
Crystalline polyester resin (endothermic peak temperature: 85° C.): 20 parts by mass
Ester wax A: 12 parts by mass
Colorant: 6 parts by mass
Charge-controlling agent: 0.5 parts by mass
The composition of the external additive is as follows.
Hydrophobic silica C (merchandise name: "RX300", product manufactured by Nippon Aerosil Co., Ltd., average primary particle diameter: 8 nm): 0.2 parts by mass
Hydrophobic silica B: 0.8 parts by mass
Hydrophobic titanium oxide: 0.5 parts by mass Example 4

The toner of Example 4 was produced similar to Example 1, except for using the following raw materials of a toner particle, and the following external additive. The volume average particle diameter of the toner particles was 7 μm, and Tg was 35.1° C.

The composition of the raw materials of the toner particle is as follows.

Amorphous polyester resin: 66 parts by mass
Crystalline polyester resin (endothermic peak temperature: 110° C.): 15 parts by mass
Ester wax A: 12 parts by mass
Colorant: 6 parts by mass
Charge-controlling agent: 1 part by mass
The composition of the external additive is as follows.
Hydrophobic silica A: 0.2 parts by mass
Hydrophobic silica B: 0.8 parts by mass
Hydrophobic titanium oxide: 0.5 parts by mass Example 5

The toner of Example 5 was produced similar to Example 1, except for using the following raw materials of a toner particle, and the following external additive. The volume average particle diameter of the toner particles was 7 μm, and Tg was 35.2° C.

The composition of the raw materials of the toner particle is as follows.

Amorphous polyester resin: 68 parts by mass
Crystalline polyester resin (endothermic peak temperature: 85° C.): 15 parts by mass
Ester wax B: 10 parts by mass
Colorant: 6 parts by mass
Charge-controlling agent: 1 part by mass
The composition of the external additive is as follows.
Hydrophobic silica D (merchandise name: "NX90G", product manufactured by Nippon Aerosil Co., Ltd., average primary particle diameter: 20 nm): 0.2 parts by mass
Hydrophobic silica B: 0.8 parts by mass
Hydrophobic titanium oxide: 0.5 parts by mass Example 6

The toner of Example 6 was produced similar to Example 1, except for using the following raw materials of a toner particle, and the following external additive. The volume average particle diameter of the toner particles was 7 μm, and Tg was 40.1° C.

The composition of the raw materials of the toner particle is as follows.

Amorphous polyester resin: 78.5 parts by mass
Crystalline polyester resin (endothermic peak temperature: 90° C.): 10 parts by mass
Ester wax B: 5 parts by mass
Colorant: 6 parts by mass
Charge-controlling agent: 0.5 parts by mass
The composition of the external additive is as follows.
Hydrophobic silica C: 0.4 parts by mass
Hydrophobic silica B: 0.8 parts by mass
Hydrophobic titanium oxide: 0.5 parts by mass Example 7

The toner of Example 7 was produced similar to Example 1, except for using the following raw materials of a toner particle, and the following external additive. The volume average particle diameter of the toner particles was 7 μm, and Tg was 43.4° C.

The composition of the raw materials of the toner particle is as follows.

Amorphous polyester resin: 85 parts by mass
Crystalline polyester resin (endothermic peak temperature: 110° C.): 5 parts by mass
Ester wax B: 3 parts by mass
Colorant: 6 parts by mass
Charge-controlling agent: 1 part by mass
The composition of the external additive is as follows.
Hydrophobic silica A: 0.4 parts by mass
Hydrophobic silica B: 0.8 parts by mass
Hydrophobic titanium oxide: 0.5 parts by mass Example 8

The toner of Example 8 was produced similar to Example 1, except for using the following raw materials of a toner particle, and the following external additive. The volume average particle diameter of the toner particles was 7 μm, and Tg was 39.8° C.

The composition of the raw materials of the toner particle is as follows.

Amorphous polyester resin: 80 parts by mass
Crystalline polyester resin (endothermic peak temperature: 80° C.): 10 parts by mass
Ester wax B: 3 parts by mass
Colorant: 6 parts by mass
Charge-controlling agent: 1 part by mass
The composition of the external additive is as follows.
Hydrophobic silica A: 0.2 parts by mass
Hydrophobic silica B: 0.8 parts by mass
Hydrophobic titanium oxide: 0.5 parts by mass Example 9

The toner of Example 9 was produced similar to Example 1, except for using the following raw materials of a toner particle, and the following external additive. The volume average particle diameter of the toner particles was 7 μm, and Tg was 32.7° C.

The composition of the raw materials of the toner particle is as follows.

Amorphous polyester resin: 48 parts by mass

Crystalline polyester resin (endothermic peak temperature: 80° C.): 32 parts by mass Ester wax C: 13 parts by mass Colorant: 6 parts by mass Charge-controlling agent: 1 part by mass The composition of the external additive is as follows.

Hydrophobic silica A: 0.2 parts by mass

Hydrophobic silica B: 0.8 parts by mass

Hydrophobic titanium oxide: 0.5 parts by mass

Example 10

The toner of Example 10 was produced similar to Example 1, except for using the following raw materials of a toner particle, and the following external additive. The volume average particle diameter of the toner particles was 7 μm, and Tg was 33.9° C.

The composition of the raw materials of the toner particle is as follows.

Amorphous polyester resin: 51.5 parts by mass

Crystalline polyester resin (endothermic peak temperature: 110° C.): 30 parts by mass Ester wax C: 12 parts by mass Colorant: 6 parts by mass Charge-controlling agent: 0.5 parts by mass The composition of the external additive is as follows.

Hydrophobic silica D: 0.2 parts by mass

Hydrophobic silica B: 0.8 parts by mass

Hydrophobic titanium oxide: 0.5 parts by mass

Example 11

The toner of Example 11 was produced similar to Example 1, except for using the following raw materials of a toner particle, and the following external additive. The volume average particle diameter of the toner particles was 7 μm, and Tg was 33.1° C.

The composition of the raw materials of the toner particle is as follows.

Amorphous polyester resin: 56 parts by mass

Crystalline polyester resin (endothermic peak temperature: 85° C.): 27 parts by mass Ester wax C: 10 parts by mass Colorant: 6 parts by mass Charge-controlling agent: 1 part by mass The composition of the external additive is as follows.

Hydrophobic silica C: 0.2 parts by mass

Hydrophobic silica B: 0.8 parts by mass

Hydrophobic titanium oxide: 0.5 parts by mass

Example 12

The toner of Example 12 was produced similar to Example 1, except for using the following raw materials of a toner particle, and the following external additive. The volume average particle diameter of the toner particles was 7 μm, and Tg was 42.1° C.

The composition of the raw materials of the toner particle is as follows.

Amorphous polyester resin: 80 parts by mass

Crystalline polyester resin (endothermic peak temperature: 110° C.): 3 parts by mass Ester wax C: 10 parts by mass Colorant: 6 parts by mass Charge-controlling agent: 1 part by mass The composition of the external additive is as follows.

Hydrophobic silica C: 0.6 parts by mass

Hydrophobic silica B: 0.8 parts by mass

Hydrophobic titanium oxide: 0.5 parts by mass

Example 13

The toner of Example 13 was produced similar to Example 1, except for using the following raw materials of a toner particle, and the following external additive. The volume average particle diameter of the toner particles was 7 μm, and Tg was 42.3° C.

The composition of the raw materials of the toner particle is as follows.

Amorphous polyester resin: 87 parts by mass

Crystalline polyester resin (endothermic peak temperature: 80° C.): 3 parts by mass Ester wax C: 3 parts by mass Colorant: 6 parts by mass Charge-controlling agent: 1 part by mass The composition of the external additive is as follows.

Hydrophobic silica A: 0.2 parts by mass

Hydrophobic silica B: 0.8 parts by mass

Hydrophobic titanium oxide: 0.5 parts by mass

Example 14

The toner of Example 14 was produced similar to Example 1, except for using the following raw materials of a toner particle, and the following external additive. The volume average particle diameter of the toner particles was 7 μm, and Tg was 35.5° C.

The composition of the raw materials of the toner particle is as follows.

Amorphous polyester resin: 68 parts by mass

Crystalline polyester resin (endothermic peak temperature: 85° C.): 15 parts by mass Ester wax D: 10 parts by mass Colorant: 6 parts by mass Charge-controlling agent: 1 part by mass The composition of the external additive is as follows.

Hydrophobic silica A: 0.6 parts by mass

Hydrophobic silica B: 0.8 parts by mass

Hydrophobic titanium oxide: 0.5 parts by mass

Example 15

The toner of Example 15 was produced similar to Example 1, except for using the following raw materials of a toner particle, and the following external additive. The volume average particle diameter of the toner particles was 7 μm, and Tg was 40.5° C.

The composition of the raw materials of the toner particle is as follows.

Amorphous polyester resin: 78 parts by mass

Crystalline polyester resin (endothermic peak temperature: 90° C.): 10 parts by mass Ester wax D: 5 parts by mass Colorant: 6 parts by mass Charge-controlling agent: 1 part by mass The composition of the external additive is as follows.

Hydrophobic silica D: 0.8 parts by mass

Hydrophobic silica B: 0.8 parts by mass
Hydrophobic titanium oxide: 0.5 parts by mass Example 16

The toner of Example 16 was produced similar to Example 1, except for using the following raw materials of a toner particle, and the following external additive. The volume average particle diameter of the toner particles was 7 μm, and Tg was 44.4° C.

The composition of the raw materials of the toner particle is as follows.

Amorphous polyester resin: 85.5 parts by mass
Crystalline polyester resin (endothermic peak temperature: 110° C.): 5 parts by mass
Ester wax D: 3 parts by mass
Colorant: 6 parts by mass
Charge-controlling agent: 0.5 parts by mass The composition of the external additive is as follows.

Hydrophobic silica A: 0.5 parts by mass
Hydrophobic silica B: 0.8 parts by mass
Hydrophobic titanium oxide: 0.5 parts by mass Example 17

The toner of Example 17 was produced similar to Example 1, except for using the following raw materials of a toner particle, and the following external additive. The volume average particle diameter of the toner particles was 7 μm, and Tg was 34.2° C.

The composition of the raw materials of the toner particle is as follows.

Amorphous polyester resin: 61 parts by mass
Crystalline polyester resin (endothermic peak temperature: 80° C.): 20 parts by mass
Ester wax E: 12 parts by mass
Colorant: 6 parts by mass
Charge-controlling agent: 1 part by mass The composition of the external additive is as follows.

Hydrophobic silica C: 0.2 parts by mass
Hydrophobic silica B: 0.8 parts by mass
Hydrophobic titanium oxide: 0.5 parts by mass Example 18

The toner of Example 18 was produced similar to Example 1, except for using the following raw materials of a toner particle, and the following external additive. The volume average particle diameter of the toner particles was 7 μm, and Tg was 34.3° C.

The composition of the raw materials of the toner particle is as follows.

Amorphous polyester resin: 61 parts by mass
Crystalline polyester resin (endothermic peak temperature: 90° C.): 20 parts by mass
Ester wax E: 12 parts by mass
Colorant: 6 parts by mass
Charge-controlling agent: 1 part by mass The composition of the external additive is as follows.

Hydrophobic silica C: 0.2 parts by mass
Hydrophobic silica B: 0.8 parts by mass
Hydrophobic titanium oxide: 0.5 parts by mass Example 19

The toner of Example 19 was produced similar to Example 1, except for using the following raw materials of a toner particle, and the following external additive. The volume average particle diameter of the toner particles was 7 μm, and Tg was 37.5° C.

The composition of the raw materials of the toner particle is as follows.

Amorphous polyester resin: 73 parts by mass
Crystalline polyester resin (endothermic peak temperature: 85° C.): 10 parts by mass
Ester wax E: 10 parts by mass
Colorant: 6 parts by mass
Charge-controlling agent: 1 part by mass The composition of the external additive is as follows.

Hydrophobic silica D: 0.6 parts by mass
Hydrophobic silica B: 0.8 parts by mass
Hydrophobic titanium oxide: 0.5 parts by mass Example 20

The toner of Example 20 was produced similar to Example 1, except for using the following raw materials of a toner particle, and the following external additive. The volume average particle diameter of the toner particles was 7 μm, and Tg was 45.1° C.

The composition of the raw materials of the toner particle is as follows.

Amorphous polyester resin: 87 parts by mass
Crystalline polyester resin (endothermic peak temperature: 110° C.): 3 parts by mass
Ester wax F: 3 parts by mass
Colorant: 6 parts by mass
Charge-controlling agent: 1 part by mass The composition of the external additive is as follows.

Hydrophobic silica C: 0.8 parts by mass
Hydrophobic silica B: 0.8 parts by mass
Hydrophobic titanium oxide: 0.5 parts by mass Example 21

The toner of Example 21 was produced similar to Example 1, except for using the following raw materials of a toner particle, and the following external additive. The volume average particle diameter of the toner particles was 7 μm, and Tg was 43.1° C.

The composition of the raw materials of the toner particle is as follows.

Amorphous polyester resin: 85 parts by mass
Crystalline polyester resin (endothermic peak temperature: 110° C.): 5 parts by mass
Ester wax F: 3 parts by mass
Colorant: 6 parts by mass
Charge-controlling agent: 1 part by mass The composition of the external additive is as follows.

Hydrophobic silica D: 0.5 parts by mass
Hydrophobic silica B: 0.8 parts by mass
Hydrophobic titanium oxide: 0.5 parts by mass Example 22

The toner of Example 22 was produced similar to Example 1, except for using the following raw materials of a toner particle, and the following external additive. The volume average particle diameter of the toner particles was 7 μm, and Tg was 42.3° C.

The composition of the raw materials of the toner particle is as follows.

Amorphous polyester resin: 80.5 parts by mass
Crystalline polyester resin (endothermic peak temperature: 110° C.): 3 parts by mass
Ester wax F: 10 parts by mass
Colorant: 6 parts by mass
Charge-controlling agent: 0.5 parts by mass
The composition of the external additive is as follows.
Hydrophobic silica C: 0.6 parts by mass
Hydrophobic silica B: 0.8 parts by mass
Hydrophobic titanium oxide: 0.5 parts by mass Example 23

The toner of Example 23 was produced similar to Example 1, except for using the following raw materials of a toner particle, and the following external additive. The volume average particle diameter of the toner particles was 7 μm, and Tg was 42.4° C.

The composition of the raw materials of the toner particle is as follows.
Amorphous polyester resin: 87.5 parts by mass
Crystalline polyester resin (endothermic peak temperature: 80° C.): 3 parts by mass
Ester wax F: 3 parts by mass
Colorant: 6 parts by mass
Charge-controlling agent: 0.5 parts by mass
The composition of the external additive is as follows.
Hydrophobic silica A: 0.2 parts by mass
Hydrophobic silica B: 0.8 parts by mass
Hydrophobic titanium oxide: 0.5 parts by mass Example 24

The toner of Example 24 was produced similar to Example 1, except for using the following raw materials of a toner particle, and the following external additive. The volume average particle diameter of the toner particles was 7 μm, and Tg was 45.0° C.

The composition of the raw materials of the toner particle is as follows.
Amorphous polyester resin: 87 parts by mass
Crystalline polyester resin (endothermic peak temperature: 110° C.): 3 parts by mass
Ester wax G: 3 parts by mass
Colorant: 6 parts by mass
Charge-controlling agent: 1 part by mass
The composition of the external additive is as follows.
Hydrophobic silica A: 0.2 parts by mass
Hydrophobic silica B: 0.8 parts by mass
Hydrophobic titanium oxide: 0.5 parts by mass Example 25

The toner of Example 25 was produced similar to Example 1, except for using the following raw materials of a toner particle, and the following external additive. The volume average particle diameter of the toner particles was 7 μm, and Tg was 43.4° C.

The composition of the raw materials of the toner particle is as follows.
Amorphous polyester resin: 80 parts by mass
Crystalline polyester resin (endothermic peak temperature: 110° C.): 10 parts by mass
Ester wax G: 3 parts by mass
Colorant: 6 parts by mass
Charge-controlling agent: 1 part by mass
The composition of the external additive is as follows.
Hydrophobic silica A: 0.8 parts by mass
Hydrophobic silica B: 0.8 parts by mass
Hydrophobic titanium oxide: 0.5 parts by mass Example 26

The toner of Example 26 was produced similar to Example 1, except for using the following raw materials of a toner particle, and the following external additive. The volume average particle diameter of the toner particles was 7 μm, and Tg was 42.8° C.

The composition of the raw materials of the toner particle is as follows.
Amorphous polyester resin: 80 parts by mass
Crystalline polyester resin (endothermic peak temperature: 85° C.): 3 parts by mass
Ester wax G: 10 parts by mass
Colorant: 6 parts by mass
Charge-controlling agent: 1 part by mass
The composition of the external additive is as follows.
Hydrophobic silica D: 0.6 parts by mass
Hydrophobic silica B: 0.8 parts by mass
Hydrophobic titanium oxide: 0.5 parts by mass Example 27

The toner of Example 27 was produced similar to Example 1, except for using the following raw materials of a toner particle, and the following external additive. The volume average particle diameter of the toner particles was 7 μm, and Tg was 43.6° C.

The composition of the raw materials of the toner particle is as follows.
Amorphous polyester resin: 80 parts by mass
Crystalline polyester resin (endothermic peak temperature: 110° C.): 5 parts by mass
Ester wax G: 5 parts by mass
Colorant: 6 parts by mass
Charge-controlling agent: 1 part by mass
The composition of the external additive is as follows.
Hydrophobic silica A: 0.5 parts by mass
Hydrophobic silica B: 0.8 parts by mass
Hydrophobic titanium oxide: 0.5 parts by mass Example 28

The toner of Example 28 was produced similar to Example 1, except for using the following raw materials of a toner particle, and the following external additive. The volume average particle diameter of the toner particles was 7 μm, and Tg was 35.6° C.

The composition of the raw materials of the toner particle is as follows.
Amorphous polyester resin: 68 parts by mass
Crystalline polyester resin (endothermic peak temperature: 85° C.): 15 parts by mass
Ester wax H: 10 parts by mass
Colorant: 6 parts by mass
Charge-controlling agent: 1 part by mass
The composition of the external additive is as follows.
Hydrophobic silica A: 0.5 parts by mass
Hydrophobic silica B: 0.8 parts by mass
Hydrophobic titanium oxide: 0.5 parts by mass Example 29

The toner of Example 29 was produced similar to Example 1, except for using the following raw materials of a toner particle, and the following external additive. The volume average particle diameter of the toner particles was 7 μm, and Tg was 40.2° C.

The composition of the raw materials of the toner particle is as follows.

Amorphous polyester resin: 78.5 parts by mass

Crystalline polyester resin (endothermic peak temperature: 90° C.): 10 parts by mass Ester wax H: 5 parts by mass Colorant: 6 parts by mass Charge-controlling agent: 0.5 parts by mass The composition of the external additive is as follows.

Hydrophobic silica D: 0.5 parts by mass

Hydrophobic silica B: 0.8 parts by mass

Hydrophobic titanium oxide: 0.5 parts by mass

Example 30

The following raw materials of a toner particle were put and mixed into a Henschel mixer.

The composition of the raw materials of the toner particle is as follows.

Amorphous polyester resin: 87 parts by mass

Crystalline polyester resin (endothermic peak temperature: 110° C.): 3 parts by mass Ester wax H: 3 parts by mass Colorant: 6 parts by mass Charge-controlling agent: 1 part by mass The mixture was molten and kneaded by a biaxial extruder. The molten-kneaded mixture was cooled, and then was coarsely pulverized by a Hammer mill. The coarsely-pulverized material was further pulverized by a pulverizer (manufactured by Hosokawa Micron Corporation), and thereby medium-pulverized particles which have a volume average particle diameter of 58 μm were obtained.

30 parts by mass of the medium-pulverized particle, 1 part by mass of an anionic surfactant (sodium dodecylbenzenesulfonate), 1 part by mass of triethylamine, and 68 parts by mass of ion exchange water were put into a homogenizer (manufactured by IKA Corporation), and were stirred. Thus, a liquid mixture was obtained.

The liquid mixture was put into a nanomizer (YSNM-2000AR, product manufactured by Yoshida Kikai Co., Ltd.). A treatment was performed three times at treatment pressure of 150 MPa at 120° C., and thereby obtaining a fine-particle dispersion. In the fine-particle dispersion, the volume average particle diameter of fine particles was 0.7 μm (SALD7000, being measured by a product manufactured by Shimadzu Corporation). pH of the fine-particle dispersion was 8.3.

The fine-particle dispersion was diluted so as to have solid content concentration of 18 wt %. While the temperature of the diluted liquid is maintained to be 30° C., 0.1M hydrochloric acid was dropped into the diluted liquid until having pH of 7.0. In the diluted liquid, the volume average particle diameter of fine particles was 0.83 μm. 0.1M hydrochloric acid was further dropped into the diluted liquid, and dropping was ended when the ζ potential of the fine particles was −30 mV. At this time, pH was 3.8.

Then, the diluted liquid was heated up to 80° C. at a rate of 10° C./min while being stirred with a paddle blade (at 500 rpm), and was held at 80° C. for one hour. After the solution was cooled, the solution was left overnight. In the diluted liquid after being left, the supernatant liquid was transparent, and not-aggregated particles were not observed. The volume average particle diameter of the diluted liquid was 6 μm, and particles of 20 μm or greater were not observed. The diluted liquid was dried by a vacuum dryer until the content was equal to or smaller than 0.8 wt %, and thereby toner particles were obtained. The volume average particle diameter of the toner particle was 6 μm, and Tg was 44.8° C. 100 parts by mass of the toner particles and the following external additive were put and mixed into a Henschel mixer, and thereby the toner of Example 30 was produced.

The composition of the external additive is as follows.

Hydrophobic silica A: 0.5 parts by mass

Hydrophobic silica B: 0.8 parts by mass

Hydrophobic titanium oxide: 0.5 parts by mass

Example 31

The toner of Example 31 was produced similar to Example 1, except for using the following raw materials of a toner particle, and the following external additive. The volume average particle diameter of the toner particles was 7 μm, and Tg was 45.1° C.

The composition of the raw materials of the toner particle is as follows.

Amorphous polyester resin: 78.5 parts by mass

Crystalline polyester resin (endothermic peak temperature: 110° C.): 3 parts by mass Ester wax H: 3 parts by mass Colorant: 6 parts by mass Charge-controlling agent: 0.5 parts by mass The composition of the external additive is as follows.

Hydrophobic silica A: 0.5 parts by mass

Hydrophobic silica B: 0.8 parts by mass

Hydrophobic titanium oxide: 0.5 parts by mass

Comparative Example 1

The toner of Comparative Example 1 was produced similar to Example 1, except for using the following raw materials of a toner particle, and the following external additive. The volume average particle diameter of toner particles was 7 μm, and Tg was 35.3° C.

The composition of the raw materials of the toner particle is as follows.

Amorphous polyester resin: 63 parts by mass

Crystalline polyester resin (endothermic peak temperature: 110° C.): 20 parts by mass Ester wax I: 10 parts by mass Colorant: 6 parts by mass Charge-controlling agent: 1 part by mass The composition of the external additive is as follows.

Hydrophobic silica A: 0.8 parts by mass

Hydrophobic silica B: 0.8 parts by mass

Hydrophobic titanium oxide: 0.5 parts by mass

Comparative Example 2

The toner of Comparative Example 2 was produced similar to Example 1, except for using the following raw materials of a toner particle, and the following external additive. The volume average particle diameter of toner particles was 7 μm, and Tg was 44.2° C.

The composition of the raw materials of the toner particle is as follows.

Amorphous polyester resin: 85 parts by mass

Crystalline polyester resin (endothermic peak temperature: 110° C.): 3 parts by mass Ester wax I: 5 parts by mass Colorant: 6 parts by mass Charge-controlling agent: 1 part by mass The composition of the external additive is as follows.
Hydrophobic silica C: 0.1 parts by mass
Hydrophobic silica B: 0.8 parts by mass
Hydrophobic titanium oxide: 0.5 parts by mass Comparative Example 3

The toner of Comparative Example 3 was produced similar to Example 1, except for using the following raw materials of a toner particle, and the following external additive. The volume average particle diameter of toner particles was 7 μm, and Tg was 29.4° C.

The composition of the raw materials of the toner particle is as follows.
Amorphous polyester resin: 54.5 parts by mass
Crystalline polyester resin (endothermic peak temperature: 115° C.): 33 parts by mass
Ester wax J: 6 parts by mass
Colorant: 6 parts by mass
Charge-controlling agent: 0.5 parts by mass
The composition of the external additive is as follows.
Hydrophobic silica A: 0.5 parts by mass
Hydrophobic silica B: 0.8 parts by mass
Hydrophobic titanium oxide: 0.5 parts by mass Comparative Example 4

The toner of Comparative Example 4 was produced similar to Example 1, except for using the following raw materials of a toner particle, and the following external additive. The volume average particle diameter of toner particles was 7 μm, and Tg was 57.5° C.

The composition of the raw materials of the toner particle is as follows.
Amorphous polyester resin: 83 parts by mass
Ester wax K: 10 parts by mass
Colorant: 6 parts by mass
Charge-controlling agent: 1 part by mass
The composition of the external additive is as follows.
Hydrophobic silica C: 0.5 parts by mass
Hydrophobic silica B: 0.8 parts by mass
Hydrophobic titanium oxide: 0.5 parts by mass Comparative Example 5

The toner of Comparative Example 5 was produced similar to Example 1, except for using the following raw materials of a toner particle, and the following external additive. The volume average particle diameter of toner particles was 7 μm, and Tg was 36.4° C.

The composition of the raw materials of the toner particle is as follows.
Amorphous polyester resin: 73 parts by mass
Crystalline polyester resin (endothermic peak temperature: 90° C.): 10 parts by mass
Ester wax J: 10 parts by mass
Colorant: 6 parts by mass
Charge-controlling agent: 1 part by mass
The composition of the external additive is as follows.
Hydrophobic silica D: 0.5 parts by mass
Hydrophobic silica B: 0.8 parts by mass
Hydrophobic titanium oxide: 0.5 parts by mass Comparative Example 6

The toner of Comparative Example 6 was produced similar to Example 1, except for using the following raw materials of a toner particle, and the following external additive. The volume average particle diameter of toner particles was 7 μm, and Tg was 42.1° C.

The composition of the raw materials of the toner particle is as follows.
Amorphous polyester resin: 81 parts by mass
Crystalline polyester resin (endothermic peak temperature: 115° C.): 6 parts by mass
Ester wax K: 6 parts by mass
Colorant: 6 parts by mass
Charge-controlling agent: 1 part by mass
The composition of the external additive is as follows.
Hydrophobic silica C: 1.0 part by mass
Hydrophobic silica B: 0.8 parts by mass
Hydrophobic titanium oxide: 0.5 parts by mass Comparative Example 7

The toner of Comparative Example 7 was produced similar to Example 1, except for using the following raw materials of a toner particle, and the following external additive. The volume average particle diameter of toner particles was 7 μm, and Tg was 32.1° C.

The composition of the raw materials of the toner particle is as follows.
Amorphous polyester resin: 63.5 parts by mass
Crystalline polyester resin (endothermic peak temperature: 85° C.): 20 parts by mass
Ester wax L: 10 parts by mass
Colorant: 6 parts by mass
Charge-controlling agent: 0.5 parts by mass
The composition of the external additive is as follows.
Hydrophobic silica C: 1.2 parts by mass
Hydrophobic silica B: 0.8 parts by mass
Hydrophobic titanium oxide: 0.5 parts by mass Comparative Example 8

The toner of Comparative Example 8 was produced similar to Example 1, except for using the following raw materials of a toner particle, and the following external additive. The volume average particle diameter of toner particles was 7 μm, and Tg was 41.6° C.

The composition of the raw materials of the toner particle is as follows.
Amorphous polyester resin: 85 parts by mass
Crystalline polyester resin (endothermic peak temperature: 110° C.): 3 parts by mass
Ester wax L: 5 parts by mass
Colorant: 6 parts by mass
Charge-controlling agent: 1 part by mass
The composition of the external additive is as follows.
Hydrophobic silica C: 1.2 parts by mass
Hydrophobic silica B: 0.8 parts by mass
Hydrophobic titanium oxide: 0.5 parts by mass Comparative Example 9

The toner of Comparative Example 9 was produced similar to Example 1, except for using the following raw materials of a toner particle, and the following external additive. The volume average particle diameter of toner particles was 7 μm, and Tg was 30.1° C.

The composition of the raw materials of the toner particle is as follows.

Amorphous polyester resin: 63 parts by mass

Crystalline polyester resin (endothermic peak temperature: 85° C.): 20 parts by mass Ester wax M: 10 parts by mass Colorant: 6 parts by mass Charge-controlling agent: 1 part by mass The composition of the external additive is as follows.

Hydrophobic silica A: 1.2 parts by mass

Hydrophobic silica B: 0.8 parts by mass

Hydrophobic titanium oxide: 0.5 parts by mass

Comparative Example 10

The toner of Comparative Example 10 was produced similar to Example 1, except for using the following raw materials of a toner particle, and the following external additive. The volume average particle diameter of toner particles was 7 μm, and Tg was 43.6° C.

The composition of the raw materials of the toner particle is as follows.

Amorphous polyester resin: 80.5 parts by mass

Crystalline polyester resin (endothermic peak temperature: 110° C.): 3 parts by mass Ester wax M: 10 parts by mass Colorant: 6 parts by mass Charge-controlling agent: 0.5 parts by mass The composition of the external additive is as follows.

Hydrophobic silica A: 1.2 parts by mass

Hydrophobic silica B: 0.8 parts by mass

Hydrophobic titanium oxide: 0.5 parts by mass

Comparative Example 11

The toner of Comparative Example 11 was produced similar to Example 1, except for using the following raw materials of a toner particle, and the following external additive. The volume average particle diameter of toner particles was 7 μm, and Tg was 33.5° C.

The composition of the raw materials of the toner particle is as follows.

Amorphous polyester resin: 58 parts by mass

Crystalline polyester resin (endothermic peak temperature: 110° C.): 20 parts by mass Ester wax N: 15 parts by mass Colorant: 6 parts by mass Charge-controlling agent: 1 part by mass The composition of the external additive is as follows.

Hydrophobic silica C: 1.0 part by mass

Hydrophobic silica B: 0.8 parts by mass

Hydrophobic titanium oxide: 0.5 parts by mass

Comparative Example 12

The toner of Comparative Example 12 was produced similar to Example 1, except for using the following raw materials of a toner particle, and the following external additive. The volume average particle diameter of toner particles was 7 μm, and Tg was 39.4° C.

The composition of the raw materials of the toner particle is as follows.

Amorphous polyester resin: 75.5 parts by mass

Crystalline polyester resin (endothermic peak temperature: 110° C.): 15 parts by mass Ester wax N: 3 parts by mass Colorant: 6 parts by mass Charge-controlling agent: 0.5 parts by mass The composition of the external additive is as follows.

Hydrophobic silica A: 0.8 parts by mass

Hydrophobic silica B: 0.8 parts by mass

Hydrophobic titanium oxide: 0.5 parts by mass

Comparative Example 13

The toner of Comparative Example 13 was produced similar to Example 1, except for using the following raw materials of a toner particle, and the following external additive. The volume average particle diameter of toner particles was 7 μm, and Tg was 45.6° C.

The composition of the raw materials of the toner particle is as follows.

Amorphous polyester resin: 80 parts by mass

Crystalline polyester resin (endothermic peak temperature: 110° C.): 10 parts by mass Ester wax O: 3 parts by mass Colorant: 6 parts by mass Charge-controlling agent: 1 part by mass The composition of the external additive is as follows.

Hydrophobic silica C: 0.8 parts by mass

Hydrophobic silica B: 0.8 parts by mass

Hydrophobic titanium oxide: 0.5 parts by mass

Comparative Example 14

The toner of Comparative Example 14 was produced similar to Example 1, except for using the following raw materials of a toner particle, and the following external additive. The volume average particle diameter of toner particles was 7 μm, and Tg was 45.6° C.

The composition of the raw materials of the toner particle is as follows.

Amorphous polyester resin: 77 parts by mass

Crystalline polyester resin (endothermic peak temperature: 110° C.): 10 parts by mass Ester wax P: 6 parts by mass Colorant: 6 parts by mass Charge-controlling agent: 1 part by mass The composition of the external additive is as follows.

Hydrophobic silica D: 0.8 parts by mass

Hydrophobic silica B: 0.8 parts by mass

Hydrophobic titanium oxide: 0.5 parts by mass

An ester wax was extracted from each of the toners of Examples 1 to 31 and Comparative Examples 1 to 14, and distribution of carbon atoms of ester compounds in the extracted ester wax was measured as follows. A measuring method of the distribution of carbon atoms of ester compounds in an ester wax extracted from a toner will be described.

0.5 g of the toner was weighed, and was stored in a conical flask. 2 mL of Methylene chloride was added to the conical flask, and the toner was dissolved. 4 ml of hexane was added to the conical flask, thereby obtaining a liquid mixture. The liquid mixture was filtered so as to be separated into a filtrate and an insoluble matter. The solvent was removed from the filtrate under a nitrogen gas stream, thereby obtaining precipitates. Similar to the ester waxes A to P, the precipitate was measured by FD-MS, and distribution of carbon atoms of ester compounds in an ester wax extracted from the toner was measured. Measurement results are shown in Table 3 and Table 4.

TABLE 3

| | Distribution of carbon atoms of ester compounds in ester wax extracted from toner | | | | | | | | |
|---|---|---|---|---|---|---|---|---|---|
| | Type of ester wax | $C_{n1}$ | a | b | C | $C_{m1}$ | Content ratio of ester compound smaller than C40 [wt %] | b/a | c/a |
| Example 1 | A | C42 | 88.9 | 93.0 | 5.6 | C46 | 1.4 | 1.046 | 0.063 |
| Example 2 | A | C42 | 87.6 | 93.0 | 5.5 | C46 | 1.5 | 1.062 | 0.063 |
| Example 3 | A | C42 | 88.8 | 93.0 | 5.7 | C46 | 1.3 | 1.047 | 0.064 |
| Example 4 | A | C42 | 87.5 | 92.7 | 5.6 | C46 | 1.7 | 1.059 | 0.064 |
| Example 5 | B | C40 | 88.7 | 91.6 | 7.3 | C46 | 1.1 | 1.033 | 0.082 |
| Example 6 | B | C40 | 88.3 | 91.8 | 7.3 | C46 | 0.9 | 1.040 | 0.083 |
| Example 7 | B | C40 | 88.4 | 91.4 | 7.4 | C46 | 1.2 | 1.034 | 0.084 |
| Example 8 | B | C40 | 88.5 | 91.7 | 7.6 | C46 | 0.7 | 1.036 | 0.086 |
| Example 9 | C | C40 | 85.6 | 88.4 | 10.2 | C48 | 1.4 | 1.033 | 0.119 |
| Example 10 | C | C40 | 86.1 | 88.9 | 9.8 | C48 | 1.3 | 1.033 | 0.114 |
| Example 11 | C | C40 | 85.9 | 88.6 | 10.2 | C48 | 1.2 | 1.031 | 0.119 |
| Example 12 | C | C40 | 85.1 | 88.3 | 10.7 | C48 | 1.0 | 1.038 | 0.126 |
| Example 13 | C | C40 | 85.3 | 88.3 | 10.6 | C48 | 1.1 | 1.035 | 0.124 |
| Example 14 | D | C42 | 58.9 | 78.9 | 20.6 | C48 | 0.5 | 1.340 | 0.350 |
| Example 15 | D | C42 | 58.7 | 78.4 | 20.8 | C48 | 0.8 | 1.336 | 0.354 |
| Example 16 | D | C42 | 58.1 | 78.8 | 20.7 | C48 | 0.5 | 1.356 | 0.356 |
| Example 17 | E | C42 | 60.4 | 66.5 | 23.6 | C48 | 9.9 | 1.101 | 0.391 |
| Example 18 | E | C42 | 60.2 | 66.8 | 23.4 | C48 | 9.8 | 1.110 | 0.389 |
| Example 19 | E | C42 | 59.4 | 67.0 | 23.5 | C48 | 9.5 | 1.128 | 0.396 |
| Example 20 | F | C40 | 85.6 | 88.8 | 9.1 | C46 | 2.1 | 1.037 | 0.106 |
| Example 21 | F | C40 | 85.4 | 88.7 | 9.5 | C46 | 1.8 | 1.039 | 0.111 |
| Example 22 | F | C40 | 85.1 | 88.2 | 10.0 | C46 | 1.8 | 1.036 | 0.118 |
| Example 23 | F | C40 | 85.2 | 88.2 | 9.9 | C46 | 1.9 | 1.035 | 0.116 |
| Example 24 | G | C40 | 56.3 | 74.9 | 24.8 | C48 | 0.3 | 1.330 | 0.440 |
| Example 25 | G | C40 | 56.3 | 74.4 | 25.4 | C48 | 0.2 | 1.321 | 0.451 |
| Example 26 | G | C40 | 56.0 | 74.3 | 25.4 | C48 | 0.3 | 1.327 | 0.454 |
| Example 27 | G | C40 | 56.1 | 74.5 | 25.3 | C48 | 0.2 | 1.328 | 0.451 |
| Example 28 | H | C40 | 56.7 | 60.3 | 37.2 | C48 | 2.5 | 1.063 | 0.656 |
| Example 29 | H | C40 | 56.4 | 60.3 | 37.3 | C48 | 2.4 | 1.069 | 0.661 |
| Example 30 | H | C40 | 56.2 | 60.8 | 37.2 | C48 | 2.0 | 1.082 | 0.662 |
| Example 31 | H | C40 | 56.4 | 60.8 | 37.0 | C48 | 2.2 | 1.078 | 0.656 |

TABLE 4

| | Distribution of carbon atoms of ester compounds in ester wax extracted from toner | | | | | | | | |
|---|---|---|---|---|---|---|---|---|---|
| | Type of ester wax | $C_{n1}$ | a | b | C | $C_{m1}$ | Content ratio of ester compound smaller than C40 [wt %] | b/a | c/a |
| Comparative Example 1 | I | C44 | 88.6 | 95.7 | 3.9 | C46 | 0.4 | 1.080 | 0.044 |
| Comparative Example 2 | I | C44 | 88.2 | 95.4 | 4.3 | C46 | 0.3 | 1.082 | 0.049 |
| Comparative Example 3 | J | C44 | 40.2 | 81.1 | 7.3 | C48 | 11.6 | 2.017 | 0.182 |
| Comparative Example 4 | J | C44 | 40.4 | 81.5 | 7.1 | C48 | 11.4 | 2.017 | 0.176 |
| Comparative Example 5 | K | C40 | 18.1 | 46.0 | 20.4 | C46 | 33.6 | 2.541 | 1.127 |
| Comparative Example 6 | K | C40 | 18.2 | 45.9 | 19.9 | C46 | 34.2 | 2.522 | 1.093 |
| Comparative Example 7 | L | C40 | 91.7 | 93.7 | 3.2 | C46 | 3.1 | 1.022 | 0.035 |
| Comparative Example 8 | L | C40 | 91.9 | 93.6 | 3.5 | C46 | 2.9 | 1.018 | 0.038 |
| Comparative Example 9 | M | C38 | 79.3 | 4.4 | 11.3 | C46 | 84.3 | 0.055 | 0.142 |
| Comparative Example 10 | M | C38 | 79.6 | 4.7 | 11.4 | C46 | 83.9 | 0.059 | 0.143 |
| Comparative Example 11 | N | C44 | 44.9 | 80.3 | 13.8 | C46 | 5.9 | 1.788 | 0.307 |
| Comparative Example 12 | N | C44 | 45.4 | 80.5 | 13.5 | C46 | 6.0 | 1.773 | 0.297 |
| Comparative Example 13 | O | C44 | 100 | 100 | 0 | — | 0 | 1.000 | 0 |
| Comparative Example 14 | P | C54 | 19.9 | 0 | 69.9 | C54 | 0 | 0 | 3.513 |

The glass transition temperature (Tg) of each of the toners in Examples 1 to 31 and Comparative Examples 1 to 14 was measured as follows. The durability of each of the toner was evaluated as follows.

A measuring method of the glass transition temperature (Tg) will be described. Tg was measured by a DSC of "DSC Q2000 (manufactured by T.A. Instruments)". Measurement conditions are as follows.

Amount of sample: 5 mg

Lid and pan: alumina

Heating rate: 10° C./min

Measuring method: a sample is heated from 20° C. to 200° C. Then, the sample is cooled until the temperature of the sample is equal to or lower than 20° C. The sample is heated again. An intersection point of a straight line and a tangent line of the following curve at an inflection point thereof is set as Tg. The straight line is obtained by extending a base line on a low temperature side of the curve which is obtained by measuring in a temperature range of 30° C. to 60° C. to a high temperature side.

As Tg of the toner becomes low, the toner has an advantage in low-temperature fixing. However, if Tg of the toner is excessively low, the durability tends to be deteriorated. Tg of the toner is preferably equal to or higher than 33° C.

An evaluating method of the durability will be described.

15 g of each of the toners was left at 55° C. for 10 hours. The left toner was sieved by using a sieve of 42 meshes, and the remaining toner on the sieve was weighed. As the amount of the remaining toner on the sieve becomes smaller, it can be evaluated that the toner has excellent durability. If the amount of the remaining toner on the sieve was equal to or smaller than 3.0 g, the toner was evaluated to be success (A). If the amount of the remaining toner on the sieve was greater than 3.0 g, the toner was evaluated to be failure (B).

6 parts by mass of each of the toners in Examples 1 to 31 and Comparative Examples 1 to 14 and 100 parts by mass of ferrite carriers were stirred in a tubular mixer, and thereby a developer was obtained. The surface of the ferrite carriers was coated with a silicone resin having a volume average particle diameter of 40 μm. The low-temperature fixing and the long-life characteristics of each of the toners were evaluated as follows by using the obtained developer.

An evaluating method of the low-temperature fixing will be described.

The developer in each of the examples was stored in a toner cartridge. The toner cartridge was disposed in e-studio6530c (manufactured by Toshiba Tec Corporation). E-studio6530c is a modified device such that a toner fixing temperature can be changed in a range of 100° C. to 200° C. in a unit of 0.1° C.

The fixing temperature was set to 150° C., and 10 solid images in which a toner attached amount is 1.5 mg/cm$^2$ were obtained. In a case where image separation due to not-fixation or offset did not occur on all of the 10 solid images, the set temperature was lowered by 1° C., and solid images were obtained similar to the above descriptions. Such an operation was repeated, and a lower limit of the fixing temperature which did not cause image separation to occur in the solid image was obtained. The obtained lower limit temperature was set as the lowest fixing temperature of the toner. Regarding a toner having the lowest fixing temperature which was equal to or lower than 120° C., the low-temperature fixing of the toner was evaluated to be success (A). Regarding a toner having the lowest fixing temperature which was higher than 120° C., the low-temperature fixing of the toner was evaluated to be failure (B).

An evaluating method of the long-life characteristics will be described.

The developer in each of the examples was stored in a toner cartridge. The toner cartridge was disposed in the commercial e-studio6530c (manufactured by Toshiba Tec Corporation). 300,000 copies of an original document (A4 size) were continuously obtained at a printing rate of 8.0% by using the toner cartridge. Then, a toner accumulated at a lower side portion of a magnetic roller of a developing machine was sucked by a cleaning machine, and the mass of the sucked toner was measured. The measured mass of the toner was set as a toner scattering amount, and the long-life characteristics of the toner were evaluated using the toner scattering amount as a reference. As the toner scattering amount becomes small, the components in the device body are contaminated less, and it can be evaluated that the toner has excellent long-life characteristics. The long-life characteristics of a toner in which the toner scattering amount was equal to or smaller than 170 mg were evaluated to be success (A). The long-life characteristics of a toner in which the toner scattering amount was greater than 170 mg were evaluated to be failure (B).

Evaluation results of the low-temperature fixing, the long-life characteristics, and the durability of each of the toners in Examples 1 to 31 and Comparative Examples 1 to 14, and measurement results of Tg thereof are shown in Table 5 and Table 6.

TABLE 5

| | Low-temperature fixing | | Durability | | Long-life characteristics | | |
|---|---|---|---|---|---|---|---|
| | Measurement result [° C.] | Evaluation | Measurement result [g] | Evaluation | Measurement result [mg] | Evaluation | Tg [° c.] |
| Example 1 | 119 | A | 0.2 | A | 55 | A | 45.1 |
| Example 2 | 119 | A | 0.4 | A | 85 | A | 45.0 |
| Example 3 | 112 | A | 2.6 | A | 165 | A | 33.7 |
| Example 4 | 113 | A | 2.4 | A | 145 | A | 35.1 |
| Example 5 | 113 | A | 2.3 | A | 135 | A | 35.3 |
| Example 6 | 117 | A | 1.1 | A | 120 | A | 40.0 |
| Example 7 | 118 | A | 1.0 | A | 90 | A | 43.6 |
| Example 8 | 116 | A | 0.3 | A | 75 | A | 39.8 |
| Example 9 | 109 | A | 2.8 | A | 170 | A | 32.7 |
| Example 10 | 110 | A | 2.6 | A | 155 | A | 33.9 |
| Example 11 | 109 | A | 2.8 | A | 165 | A | 33.1 |
| Example 12 | 117 | A | 0.4 | A | 100 | A | 42.1 |
| Example 13 | 117 | A | 0.3 | A | 80 | A | 42.4 |
| Example 14 | 115 | A | 2.3 | A | 155 | A | 35.5 |

TABLE 5-continued

| | Low-temperature fixing | | Durability | | Long-life characteristics | | |
|---|---|---|---|---|---|---|---|
| | Measurement result [° C.] | Evaluation | Measurement result [g] | Evaluation | Measurement result [mg] | Evaluation | Tg [° c.] |
| Example 15 | 117 | A | 1.7 | A | 125 | A | 40.5 |
| Example 16 | 118 | A | 0.8 | A | 80 | A | 44.4 |
| Example 17 | 114 | A | 2.9 | A | 155 | A | 34.2 |
| Example 18 | 114 | A | 2.7 | A | 150 | A | 34.3 |
| Example 19 | 116 | A | 1.7 | A | 115 | A | 37.5 |
| Example 20 | 120 | A | 0.4 | A | 80 | A | 45.1 |
| Example 21 | 119 | A | 0.3 | A | 85 | A | 43.1 |
| Example 22 | 113 | A | 0.2 | A | 110 | A | 42.3 |
| Example 23 | 116 | A | 0.4 | A | 80 | A | 42.4 |
| Example 24 | 118 | A | 0.3 | A | 75 | A | 45.0 |
| Example 25 | 119 | A | 0.9 | A | 100 | A | 43.4 |
| Example 26 | 117 | A | 1.2 | A | 110 | A | 42.8 |
| Example 27 | 116 | A | 0.7 | A | 75 | A | 43.6 |
| Example 28 | 114 | A | 1.6 | A | 125 | A | 35.6 |
| Example 29 | 117 | A | 1.5 | A | 110 | A | 40.2 |
| Example 30 | 119 | A | 1.2 | A | 70 | A | 44.8 |
| Example 31 | 120 | A | 0.1 | A | 30 | A | 45.1 |

TABLE 6

| | Low-temperature fixing | | Durability | | Long-life characteristics | | |
|---|---|---|---|---|---|---|---|
| | Measurement result [° C.] | Evaluation | Measurement result [g] | Evaluation | Measurement result [mg] | Evaluation | Tg [° C.] |
| Comparative Example 1 | 117 | A | 7.8 | B | 200 | B | 35.3 |
| Comparative Example 2 | 127 | B | 3.2 | B | 180 | B | 44.2 |
| Comparative Example 3 | 110 | A | 10.6 | B | 360 | B | 29.4 |
| Comparative Example 4 | 140 | B | 1.0 | A | 160 | A | 57.5 |
| Comparative Example 5 | 115 | A | 7.6 | B | 205 | B | 36.4 |
| Comparative Example 6 | 125 | B | 5.5 | B | 175 | B | 42.1 |
| Comparative Example 7 | 111 | A | 10.2 | B | 340 | B | 32.1 |
| Comparative Example 8 | 123 | B | 4.9 | B | 205 | B | 41.6 |
| Comparative Example 9 | 108 | A | 15 (Lump) | B | 360 | B | 30.1 |
| Comparative Example 10 | 124 | B | 4.2 | B | 205 | B | 43.6 |
| Comparative Example 11 | 116 | A | 3.5 | B | 180 | B | 33.5 |
| Comparative Example 12 | 121 | B | 2.2 | A | 165 | A | 39.4 |
| Comparative Example 13 | 125 | B | 6.4 | B | 185 | B | 45.6 |
| Comparative Example 14 | 127 | B | 0.1 | A | 160 | A | 45.6 |

In the evaluation for the low-temperature toner fixing, the durability, and the long-life characteristics, all of the toners of Example 1 to 31 passed. Tg of each of the toners in Examples was equal to or higher than 33° C.

The toners in Examples 1 to 31 contained the ester waxes A to H, and thus were excellent in low-temperature toner fixing. Precipitation of the ester wax from the toner particle when being left at a high temperature is difficult, and thus the durability was excellent. In Examples 1 to 31, precipitation of the colorant and the ester wax to the surface of the toner particle is suppressed by using the ester waxes A to H. Thus, the charge stability was improved and the long-life characteristics were good.

On the contrary, regarding the toners in Comparative Examples 1 to 14, having the entire performance of the low-temperature fixing, the durability, and the long-life characteristics together was not possible.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner, comprising:

a colorant;

a binder resin; and an ester wax, wherein:

the colorant, the binder resin and the ester wax form a toner particle, the ester wax contains a plurality of ester compounds, each ester compound represented by the general formula $R^1COOR^2$, where:

$R^1$ and $R^2$ each independently is an alkyl group in which a total number of carbon atoms of $R^1$ and $R^2$ is in a range from 31 to 53, the plurality of ester compounds comprises:

a first ester compound that has the greatest weight percentage among the plurality of ester compounds in the ester wax, the first ester compound having a total number of carbon atoms within a range from 40 to 44, endpoints inclusive, and a second ester compound that has a number of carbon atoms greater than 44, and the ester wax satisfies the formulas $1.03 \leq b/a \leq 1.61$ and $0.06 \leq c/a \leq 0.90$, where:

"a" indicates the total content of the first ester compound by weight percentage of the ester wax, "b" indicates the total content of all ester compounds among the plurality of ester compounds which have a number of carbon atoms within the range from 40 to 44 by weight percentage of the ester wax, and "c" indicates the total content of all ester compounds among the plurality of ester compounds which have a total number of carbon atoms greater than 44, wherein:

the first ester compound has a total number carbon atoms equal to $C_{n1}$ and the second ester compound has a total number of carbon atoms equal to $C_{m1}$, and the difference between $C_{m1}$ and $C_{n1}$ is equal to or greater than 4.

2. The toner according to claim 1, wherein the difference between $C_{m1}$ and $C_{n1}$ is equal to or less than 8.

3. The toner according to claim 2, wherein the difference between $C_{m1}$ and $C_{n1}$ is 6.

4. The toner according to claim 2, wherein the binder resin contains a crystalline polyester resin.

5. The toner according to claim 4, wherein:

an endothermic peak temperature of the ester wax measured by a differential scanning calorimeter is in a range from 60° C. to 75° C., and an endothermic peak temperature of the crystalline polyester resin measured by the differential scanning calorimeter is in a range from 78° C. to 110° C.

6. The toner according to claim 1, wherein the second ester compound has the second greatest weight percentage among the plurality of the ester compounds in the ester wax.

7. The toner according to claim 1, wherein a weight percentage of the ester wax with respect to the toner particle is in a range from 3% to 13%.

8. The toner according to claim 1, wherein:

a weight percentage of the first ester compound with respect to the ester wax is in a range from 56% to 88%, and a weight percentage of the second ester compound with respect to the ester wax is in a range from 4% to 20%.

9. An image forming apparatus, comprising:

a photoreceptor drum;

a charging charger configured to charge a surface of the photoreceptor drum;

a laser unit configured to form an electrostatic latent image on the surface of the photoreceptor drum;

a developing device including a toner and configured to develop the electrostatic latent image with the toner;

a transfer charger configured to transfer the developed image onto a sheet; and a cleaning device configured to remove a residual toner on the photoreceptor drum, wherein the toner includes:

a colorant;

a binder resin; and an ester wax, wherein:

the colorant, the binder resin and the ester wax form a toner particle, the ester wax contains a plurality of ester compounds, each ester compound represented by the general formula $R^1COOR^2$, where:

$R^1$ and $R^2$ each independently is an alkyl group in which a total number of carbon atoms of $R^1$ and $R^2$ is in a range from 31 to 53, the plurality of ester compounds comprises:

a first ester compound that has the greatest weight percentage among the plurality of ester compounds in the ester wax, the first ester compound having a total number of carbon atoms within a range from 40 to 44, endpoints inclusive, and a second ester compound that has a number of carbon atoms greater than 44, and the ester wax satisfies the formulas $1.03 \leq b/a \leq 1.61$ and $0.06 \leq c/a \leq 0.90$, where:

"a" indicates the total content of the first ester compound by weight percentage of the ester wax, "b" indicates the total content of all ester compounds among the plurality of ester compounds which have a number of carbon atoms within the range from 40 to 44 by weight percentage of the ester wax, and "c" indicates the total content of all ester compounds among the plurality of ester compounds which have a total number of carbon atoms greater than 44, wherein:

the first ester compound has a total number carbon atoms equal to $C_{n1}$ and the second ester compound has a total number of carbon atoms equal to $C_{m1}$, and the difference between $C_{m1}$ and $C_{n1}$ is equal to or greater than 4.

10. The image forming apparatus according to claim 9, wherein the difference between $C_{m1}$ and $C_{n1}$ is equal to or less than 8.

11. The image forming apparatus according to claim 10, wherein the difference between $C_{m1}$ and $C_{n1}$ is 6.

12. The image forming apparatus according to claim 10, wherein the binder resin contains a crystalline polyester resin.

13. The image forming apparatus according to claim 12, wherein:

an endothermic peak temperature of the ester wax measured by a differential scanning calorimeter is in a range from 60° C. to 75° C., and an endothermic peak temperature of the crystalline polyester resin measured by the differential scanning calorimeter is in a range from 78° C. to 110° C.

14. The image forming apparatus according to claim 9, wherein the second ester compound has the second greatest weight percentage among the plurality of the ester compounds in the ester wax.

15. The image forming apparatus according to claim 9, wherein a weight percentage of the ester wax with respect to the toner particle is in a range from 3% to 13%.

16. The image forming apparatus according to claim 9, wherein:

a weight percentage of the first ester compound with respect to the ester wax is in a range from 56% to 88%, and a weight percentage of the second ester compound with respect to the ester wax is in a range from 4% to 20%.

* * * * *